US011423875B2

(12) United States Patent
Luan et al.

(10) Patent No.: US 11,423,875 B2
(45) Date of Patent: Aug. 23, 2022

(54) HIGHLY EMPATHETIC ITS PROCESSING

(71) Applicant: Microsoft Technology Licensing, LLC, Redmond, WA (US)

(72) Inventors: Jian Luan, Beijing (CN); Shihui Liu, Redmond, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 21 days.

(21) Appl. No.: 17/050,153

(22) PCT Filed: May 13, 2019

(86) PCT No.: PCT/US2019/031918
§ 371 (c)(1),
(2) Date: Oct. 23, 2020

(87) PCT Pub. No.: WO2019/231638
PCT Pub. Date: Dec. 5, 2019

(65) Prior Publication Data

US 2021/0082396 A1 Mar. 18, 2021

(30) Foreign Application Priority Data

May 31, 2018 (CN) ..... 201810551651.8

(51) Int. Cl.
*G10L 13/10* (2013.01)
*G10L 13/047* (2013.01)

(52) U.S. Cl.
CPC ..... *G10L 13/10* (2013.01); *G10L 13/047* (2013.01); *G10L 2013/105* (2013.01)

(58) Field of Classification Search
CPC ..... G10L 13/047; G10L 13/10; G10L 13/00
See application file for complete search history.

(56) References Cited

U.S. PATENT DOCUMENTS 8,326,629 B2 12/2012 Skuratovsky
9,280,967 B2 3/2016 Fume et al.
(Continued)

FOREIGN PATENT DOCUMENTS

EP 2846327 A1 3/2015
JP 2004117662 A * 4/2004
(Continued)

OTHER PUBLICATIONS

"Audiobook Creator", Retrieved from: https://web.archive.org/web/20140729010023/http:/audiobookcreator.codingday.com/, Jul. 29, 2014, 3 Pages.
(Continued)

*Primary Examiner* — Shreyans A Patel
(74) *Attorney, Agent, or Firm* — Schwegman Lundberg & Woessner, P.A.

(57) ABSTRACT

The present disclosure provides a technical solution of highly empathetic TTS processing, which not only takes a semantic feature and a linguistic feature into consideration, but also assigns a sentence ID to each sentence in a training text to distinguish sentences in the training text. Such sentence IDs may be introduced as training features into a processing of training a machine learning model, so as to enable the machine learning model to learn a changing rule for the changing of acoustic codes of sentences with a context of sentence. A speech naturally changed in rhythm and tone may be output to make TTS more empathetic by performing TTS processing with the trained model. A highly empathetic audio book may be generated using the TTS processing provided herein, and an online system for generating a highly empathetic audio book may be established with the TTS processing as a core technology.

15 Claims, 14 Drawing Sheets

(56) References Cited

U.S. PATENT DOCUMENTS

| | | | | |
|---|---|---|---|---|
| 9,378,651 | B2 | 6/2016 | Duga | |
| 10,769,677 | B1 * | 9/2020 | Agrawal | G06F 16/9535 |
| 2009/0326948 | A1 | 12/2009 | Agarwal et al. | |
| 2014/0007257 | A1 | 1/2014 | Dougherty et al. | |
| 2015/0356967 | A1 | 12/2015 | Byron et al. | |
| 2016/0379638 | A1 | 12/2016 | Basye et al. | |

FOREIGN PATENT DOCUMENTS

| | | | | |
|---|---|---|---|---|
| JP | 2004117663 | A | * | 4/2004 |
| WO | 2017109759 | A1 | | 6/2017 |

OTHER PUBLICATIONS

"Word embedding", Retrieved from: https://en.wikipedia.org/wiki/Word_embedding, Retrieved Date: Nov. 6, 2020, 6 Pages.

"Word2vec", Retrieved from: https://en.wikipedia.org/wiki/Word2vec, Retrieved Date: Nov. 6, 2020, 7 Pages.

Iida, et al., "A Corpus-based Speech Synthesis System with Emotion", In Journal of Speech Communication, vol. 40, Issue 1-2, Apr. 2003, pp. 161-187.

"International Search Report and Written Opinion Issued in PCT Application No. PCT/US19/031918", dated Jul. 26, 2019, 12 Pages.

* cited by examiner

HIGHLY EMPATHETIC ITS PROCESSING

CROSS-REFERENCE TO RELATED APPLICATION

This application is a U.S. National Stage Filing under 35 U.S.C. 371 of International Patent Application Serial No. PCT/US2019/031918, filed May 13, 2019, and published as WO 2019/231638 A1 on Dec. 5, 2019, which claims priority to Chinese Application No. 201810551651.8, filed May 31, 2018; which applications and publication are incorporated herein by reference in their entirety.

BACKGROUND

As a kind of technique for speech conversion and speech synthesis, the TTS (Text To Speech) may convert a text file into speech output in natural language. TTS is widely applied in many fields, such as intelligent chat robots, speech navigation, online translation, online education. TTS can not only help people with visual disorder problem read information displayed on computers, but also improve the readability of text documents by the processing of reading texts, so as to enable users to acquire content of texts even when it is inconvenient for them to perform reading visually.

BRIEF SUMMARY

The embodiments of the present disclosure are provided to give a brief introduction to some concepts, which would be further explained in the following description. This Summary is not intended to identify essential technical features or important features of the subject as claimed nor to limit the scope of the subject as claimed.

The embodiments of the present disclosure may provide a technical solution of highly empathetic TTS processing, which not only takes a semantic feature and a linguistic feature into consideration, but also assigns a sentence ID to each sentence in a training text to distinguish sentences in the training text. Such sentence IDs may be introduced as training features into a processing of training a machine learning model, so as to enable the machine learning model to learn a changing rule for the changing of acoustic codes of sentences with a context of sentence. A speech which may be naturally changed in rhythm and tone may be output to make TTS more empathetic by performing TTS processing with the trained model. A highly empathetic audio book may be generated using the TTS processing provided herein, and an online system for generating a highly empathetic audio book may be established with the TTS processing as a core technology.

The above description is merely a brief introduction of the technical solutions of the present disclosure, so that the technical means of the present disclosure may be clearly understood, and implemented according to the description of the specification, and the above and other technical objects, features and advantages of the present disclosure may be more obvious based on the embodiments of the present disclosure as follows.

DETAILED DESCRIPTION

Figure 1:
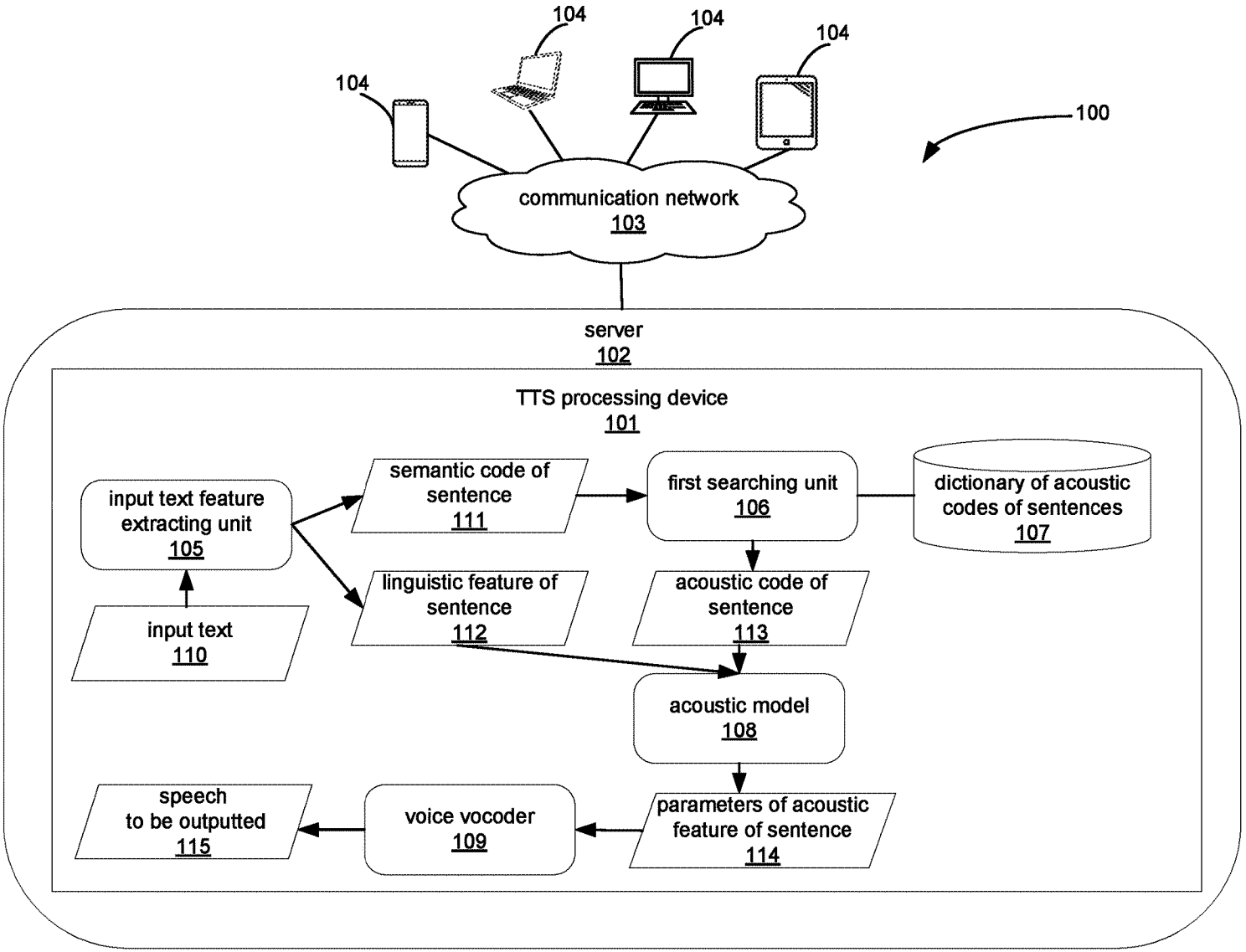
FIG. 1 is an exemplary block diagram showing an application environment of a structure of an illustrative TTS processing device according to embodiments of the present disclosure.

In the following, description will be given in detail on the exemplary embodiments of the present disclosure, in connection with the accompanying drawing. Although drawings show the exemplary embodiments of the present disclosure, it should be appreciated that the present disclosure may be implemented in various ways without being limited by the embodiments set forth herein. On the contrary, these embodiments are provided for thorough understanding of the present disclosure, and completely conveying the scope of the present disclosure to the skills in the art.

The following description sets forth various examples along with specific details to provide a thorough understanding of claimed subject matter. It will be understood by those skilled in the art, however, the claimed subject matter may be practiced without some or more of the specific details disclosed herein. Further, in some circumstances, well-known methods, procedures, systems, components and/or circuits have not been described in detail in order to avoid unnecessarily obscuring claimed subject matter.

In the following detailed description, reference is made to the accompanying drawings, which form a part hereof.

In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

It will be readily understood that the aspects of the present disclosure, as generally described herein, and illustrated in the figures, can be arranged, substituted, combined, and designed in a wide variety of different configurations, all of which are explicitly contemplated and make part of this disclosure.

The term "technique", as cited herein, for instance, may refer to system(s), method(s), computer-readable instructions, module(s), algorithms, hardware logic (e.g., Field-programmable Gate Arrays (FPGAs), Application-specific Integrated Circuits (ASICs), Application-specific Standard Products (ASSPs), System-on-a-chip systems (SOCs), Complex Programmable Logic Devices (CPLDs)), and/or other technique(s) as permitted by the context above and throughout the document.

Overview

A TTS technology is a technology for generating a speech to be outputted based on an input text, and is used in many technical fields. In the TTS technology of the prior art, speeches outputted by TTS are in a monotone style, lack diversity and changes in tone and are less expressive. For example, when a current ordinary intelligent chatbot is telling a story based the TTS technology, the chatbot may output sentences with same rhythm during its reading, just like performing a simple speech conversion sentence by sentence, and it may be impossible for the generated speeches to be changed with the context of the story. Therefore, the speech of the chatbot is less empathetic, and fails to express the feeling of reading by human beings. Even if the styles of some speeches outputted by the TTS have some changes, the changes of style may be unexpected to the listeners without natural transition, and have huge difference from the language style of human beings.

When human beings are telling a story or reading an article, the rhythm of sentences may be changed with the progress of the story or article, and with the changes of context contents, so as to exhibit some emotions. Such changes may be natural and smooth in connection. The TTS technology presented in the embodiments of the present disclosure is to learn such changing rules with a machine learning method, so as to make TTS output empathetic.

More particularly, in the training on a machine learning model, in addition that semantic features and linguistic features are considered, sentence IDs may be assigned to each sentence in a training text to distinguish between the sentences in the training text. Such sentence IDs may be further used as training features in the training on the machine learning model, so as to enable the machine learning model to learn acoustic codes of sentence corresponding to each sentence, and learn a changing rule of acoustic codes of sentence in being changed with at least one of semantic features, linguistic features, and the acoustic codes of sentence in context of sentence. During a text to speech conversion using the trained machine learning model, the context of sentences may be combined with at least one of the semantic features, the linguistic features, or the acoustic code features, so as to output an output speech naturally changed in rhythm and tone, and make TTS more expressive and empathetic.

Functions of the machine learning model disclosed herein mainly include: an acoustic model for generating parameters of acoustic feature of sentence and a sequential model for predicting an acoustic code of sentence. Furthermore, the training processing on the machine learning model may generate a dictionary of acoustic codes of sentences in addition to the machine learning model itself.

The acoustic model may include a phoneme duration model, a U/V model, an F0 model, and an energy spectrum model. Accordingly, the parameters of acoustic feature of sentence generated by the processing on the acoustic model may include a phoneme duration parameter, a U/V parameter, an F0 parameter, and an energy spectrum parameter. Among these parameters of acoustic feature of sentence, the phoneme duration parameter, the U/V parameter, and the F0 parameter are all the parameters associated with rhythm. Tones of speeches by different people may be mainly associated with the parameters in rhythm, while the energy spectrum parameter may be associated with the tone of sound.

The sequential model may be configured to predict an acoustic code of sentence of the current sentence according to the acoustic codes of sentence of the pervious sentences and a semantic code of sentence of the current sentence. In the training processing and online using on the sequential model, it may be necessary to use the acoustic codes of sentence of the previous sentences, so that the generated acoustic code of sentence may have an effect of being naturally changed and transited with the progress of the text content.

The dictionary of acoustic codes of sentences may include a plurality of items consisted of semantic codes of sentence, IDs of sentence and acoustic codes of sentence, which have mapping relationship therebetween. In a dictionary of acoustic codes of sentences, the semantic codes of sentence, and the IDs of sentence are equivalent to index items, and an appropriate acoustic code of sentence may be found by using a semantic code of sentence and/or a sentence ID.

When the TTS processing is performed, ways of using on the machine learning model and the dictionary of acoustic codes of sentences may be different according to the ways for acquiring the acoustic codes of sentence. More particularly, the ways of using on the machine learning model and the dictionary of acoustic codes of sentences may include three ways as follows.

The first way (referred as "Way I" hereafter) is to perform searching in a dictionary of acoustic codes of sentences based on a semantic code of sentence.

The acoustic code of sentence corresponding to a sentence meeting a similarity condition may be found by performing a similarity searching in a dictionary of acoustic codes of sentences according to semantic codes of sentence of each sentence in the input text. If there are a plurality of sentences meeting the similarity condition, selection may be performed on the sentences according to the semantic codes of sentence of the sentences in the context or the combination of the semantic codes of sentence of the sentences in the context with the IDs of the sentences.

The second way (referred as "Way II" hereafter) is to perform prediction based on a sequential model.

An acoustic code of sentence may be predicted based on the sequential model without using a dictionary of acoustic codes of sentences, and the acoustic code of sentence of the current sentence may be generated only according to the acoustic codes of sentence of a plurality of the previous sentences and the semantic code of sentence of the current sentence.

The third way (referred as "Way III" hereafter) is to perform searching in a dictionary of acoustic codes of sentences based on a sentence ID.

A sentence ID of a sentence in a training text corresponding to a sentence in an input text may be acquired according to the position corresponding relationship between each sentence in an input text and each sentence in a training text with the training text as a template. An acoustic code of sentence may be then acquired by performing searching in a dictionary of acoustic codes of sentences according to the acquired sentence ID. The number of sentences in the input text may be different from the number of sentences in the training text, and the sentence IDs may be acquired by interpolation calculation.

Detailed description may be made on TTS processing technology according to embodiments of the present disclosure in the following examples.

EXAMPLES

As shown in FIG. 1, which is an exemplary block diagram 100 showing an application environment of a structure of an illustrative TTS processing device according to embodiments of the present disclosure, the TTS processing device 101 shown in FIG. 1 may be provided in a server 102, and the server 102 may be in communication connection with a plurality of types of user terminals 104 through a communication network 103. More particularly, the user terminals 104 may be a small type portable (or mobile) electronic apparatus. The small type portable (or mobile) electronic apparatus may be e.g., cell phone, personal data assistant (PDA), notebook, laptop, tablet, personal media player, wireless network player, personal headset, specialized device or a mixed device including any of the above functions. The user terminals 104 may be a computing apparatus such as desktop computer, a specialized server.

Applications having a function of playing a voice may be installed in the user terminals 104. Such applications may be, for example, a chatbot application for human-machine conversation, or a news client application having a function of playing a voice, or an application for reading a story online. Such applications may provide a text file to be converted into a speech to be outputted as an input text to the TTS processing device 101 in the server 102, to generate parameters of acoustic feature of sentence corresponding to each sentence in the input text, and send the parameters of acoustic feature of sentence to an application in the user terminal 104 through the communication network 103. Such applications may generate the speech to be outputted according to the parameters of acoustic feature of sentence by calling a local voice vocoder, and play the speech to be outputted to a user. In some embodiments, the voice vocoder may be provided in the server 102 as a part of the TTS processing device 101 (as shown in FIG. 1), so as to directly generate the speech to be outputted and send the speech to be outputted to the user terminal 104 through the communication network 103.

Furthermore, in some examples, the TTS processing device 101 provided in the embodiments of the present disclosure may be a small type portable (or mobile) electronic apparatus or provided in a small type portable (or mobile) electronic apparatus. Furthermore, the TTS processing device 101 described above may be implemented as a computing apparatus, such as a desktop computer, a laptop computer, a tablet, a specialized server, or provided therein. The applications having the function of playing voice as described above may be provided in such computing apparatus or electronic apparatus, so that the speech to be output may be generated by using the TTS processing device thereof.

Exemplary Structure of a TTS Processing Device

As shown in FIG. 1, as an exemplary structure, the above TTS processing device 101 may include: an input text feature extracting unit 105, a first searching unit 106, an acoustic model 108, and a voice vocoder 109.

The input text feature extracting unit 105 may be configured to extract a text feature from each sentence in an input text 110, to acquire a semantic code of sentence 111 and a linguistic feature of sentence 112 of each sentence in the input text.

The semantic code of sentence 111 may be generated by extracting a feature with respect to a semantic feature of sentence, and specifically may be generated by word embedding or word2vector.

The linguistic feature of sentence 112 may be generated by extracting a feature from a linguistic feature of sentence. Such features may include: tri-phoneme, tone type, part of speech, prosodic structure, and the like, as well as word, phrase, sentence, paragraph and session embedding vector.

The first searching unit 106 may be configured to perform similarity match searching in a dictionary of acoustic codes of sentences 107 according to the semantic code of sentence 111 of the each sentence in the input text 110, and acquire the acoustic code of sentence 113 matched with the semantic code of sentence. More particularly, the dictionary of acoustic codes of sentences 107 includes a plurality of items consisted of semantic codes of sentence, IDs of sentence and acoustic codes of sentence, which have mapping relationship therebetween. The dictionary of acoustic codes of sentences 107 may be obtained by a training processing based on a training text. In the training processing, the sequential relationship of context of sentence may be used as a training feature, so that the acoustic code of sentence in the items of the dictionary of acoustic codes of sentences 107 may have a characteristic of being naturally changed according to the context relationship of sentences.

Furthermore, there may be a plurality of results of the similarity match searching performed in the dictionary of acoustic codes of sentences 107 based on the semantic code of sentence, i.e., there may be a plurality of matched items found. In view of this situation, similarity match searching may be performed in the dictionary of acoustic codes of sentences 107 according to the semantic code of sentence of the each sentence in the input text and the semantic codes of sentence of a preset number of sentences in the context of the each sentence, to acquire an acoustic code of sentence matched with the semantic code of sentence of the various sentences in the input text.

For example, there is a sentence of "I find that it is fine today" in an input text. In the dictionary of acoustic codes of sentences 107, due to the repetition of the sentences in the text, there may be a plurality of sentences much similar with or completely identical with the sentences in semantic code of sentence, and there may be a plurality of acoustic codes of sentence corresponding to such sentences much similar with or completely identical with the sentences in semantic code of sentence. Some acoustic codes of sentence may correspond to rhythms for happiness, while some acoustic codes of sentence may correspond to rhythms for sadness.

If the context of the sentence of "I find that it is fine today" is a sentence showing happiness, e.g., the context related to that sentence is: "Today I have passed the examination. I find that it is fine today. I go to the park for a walk.", the acoustic code of sentence corresponding to the sentence of "I find that it is fine day" should correspond to a rhythm for happiness. If the context of the sentence of "I find that it is fine today" is a sentence showing depression, e.g., the context related to that sentence is "Today I have failed to pass the examination. I find that it is fine day, but I completely would not like to go out." the acoustic code of sentence corresponding to the sentence of "I find that it is fine day" should correspond to a rhythm for sadness. An appropriate acoustic code of the sentence may be determined by further performing comparing of the similarity between the acoustic codes of sentence in the context of the sentence of "I find that it is fine today" in the dictionary of acoustic codes of sentences 107.

It should be noted that the above ways of performing searching with the semantic code of sentence of the current sentence and the semantic code of sentence of the sentence in the context combined with each other may be performed from the beginning rather than only after a plurality of matched items are found. For example, different weight values may be assigned to the semantic code of sentence of the current sentence and the semantic codes of sentence of the sentences in the context. Then the overall similarity between the sentence and the sentences in the context and the sentences in the dictionary of acoustic codes of sentences is calculated, so as to perform ranking according to the overall similarity and select the sentence with highest ranking as the searching result.

In addition, considering the above situation of finding a plurality of matched items, selection on sentences may be performed according to position information. A sentence ID corresponding to each sentence in the input text may be determined with a training text for training the dictionary of acoustic codes of sentences 107 as the template, and similarity match searching may be performed in the dictionary of acoustic codes of sentences according to the semantic code of sentence and the determined sentence ID of the each sentence in the input text, so as to acquire the acoustic code of sentence matched with the semantic code of sentence of the each sentence in the input text. The number of sentences in the input text may be different from the number of sentences in the training text as the template, and the corresponding sentence ID may be acquired by interpolation calculation. Detailed description would be made on examples for acquiring the sentence ID by interpolation calculation hereinafter.

The acoustic model 108 may be configured to generate parameters of acoustic feature of sentence 114 of the each sentence in the input text 110 according to the acoustic code of sentence 113 and the linguistic feature of sentence 112 of the each sentence in the input text 110.

The acoustic code of sentence may describe the overall audio frequency of a sentence, and shows the style of the whole audio of the sentence. It may be assumed that the dimension of the acoustic code is 16, and the audio of the sentence may correspond to a set of 16-dimension vectors.

A parameter of acoustic feature of sentence is obtained by sampling an audio signal of a sentence to express an audio signal in a digital form. Each frame corresponds to a set of acoustic parameters, and a sentence may correspond to the sampling on a plurality of frames. On the other hand, upon determining the parameters of acoustic feature of sentence, the audio signal of the sentence may be restored through a reverse process to generate a speech to be outputted, which may be particularly implemented by using a voice vocoder 109.

The voice vocoder 109 may be configured to generate a speech to be outputted 115 according to the parameters of acoustic feature of sentence of the each sentence in the input text 110. The voice vocoder 109 may be provided in the server 102, or provided in the user terminal 104.

Training Device for Machine Learning Corresponding to the TTS Processing Device 101

Figure 2:
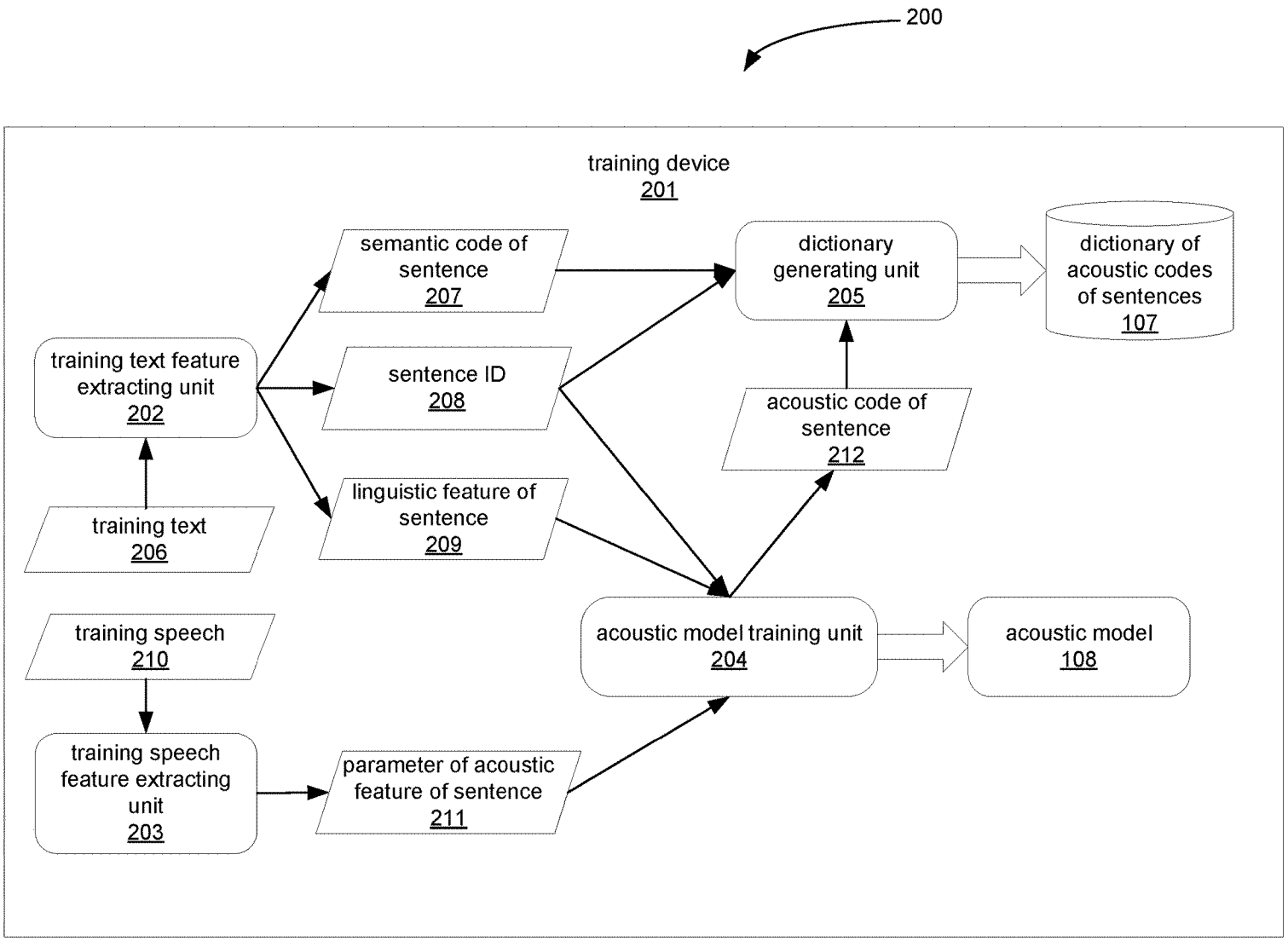
FIG. 2 is an exemplary block diagram of a structure of a training device for machine learning corresponding to the TTS processing device shown in FIG. 1.

As shown in FIG. 2, which is an exemplary block diagram 200 of a structure of a training device for machine learning corresponding to the TTS processing device shown in FIG. 1, the training device for machine learning may perform training on the acoustic training model by using the training text and the training speech corresponding to the training text as the training data (the training may be an online training or an offline training), to generate the dictionary of acoustic codes of sentences 107 and the acoustic model 108 shown in FIG. 1. The structure of machine learning model of a GRU (Gated Recurrent Unit) or LSTM (Long Short-Term Memory) may be used for the acoustic training model.

More particularly, the training device 201 may include a training text feature extracting unit 202, a training speech feature extracting unit 203, an acoustic model training unit 204, and a dictionary generating unit 205.

The training text feature extracting unit 202 may be configured to extract a text feature from each sentence in a training text 206, to acquire a semantic code of sentence 207, a sentence ID 208, and a linguistic feature of sentence 209 of the each sentence.

The training speech feature extracting unit 203 may be configured to extract a speech feature from a training speech 210, to acquire a parameter of acoustic feature of sentence 211 of the each sentence.

The acoustic model training unit 204 may be configured to input the sentence ID 208 of the each sentence, the linguistic feature of sentence 209 of the each sentence, and the parameter of acoustic feature of sentence 211 of the each sentence into an acoustic training model as first training data, to generate an acoustic model 108 and an acoustic code of sentence 212 of the each sentence.

The dictionary generating unit 205 may be configured to establish a mapping relationship between the semantic code of sentence 207, the sentence ID 208, and the acoustic code of sentence 212 of the each sentence, to generate the items in the dictionary of acoustic codes of sentences 107.

It may be seen from the training processing performed by the training device 201 that, the dictionary of acoustic codes of sentences 107 and the acoustic model 108 generated by training of the training device are not only associated with the semantic code of sentence of a sentence, but also associated with the position of the sentence in the training text and context relationship of the sentence, so that the generated speech to be outputted may be a naturally changed and transited in rhythm with the development of the input text.

Exemplary Structure of a TTS Processing Device

Figure 3:
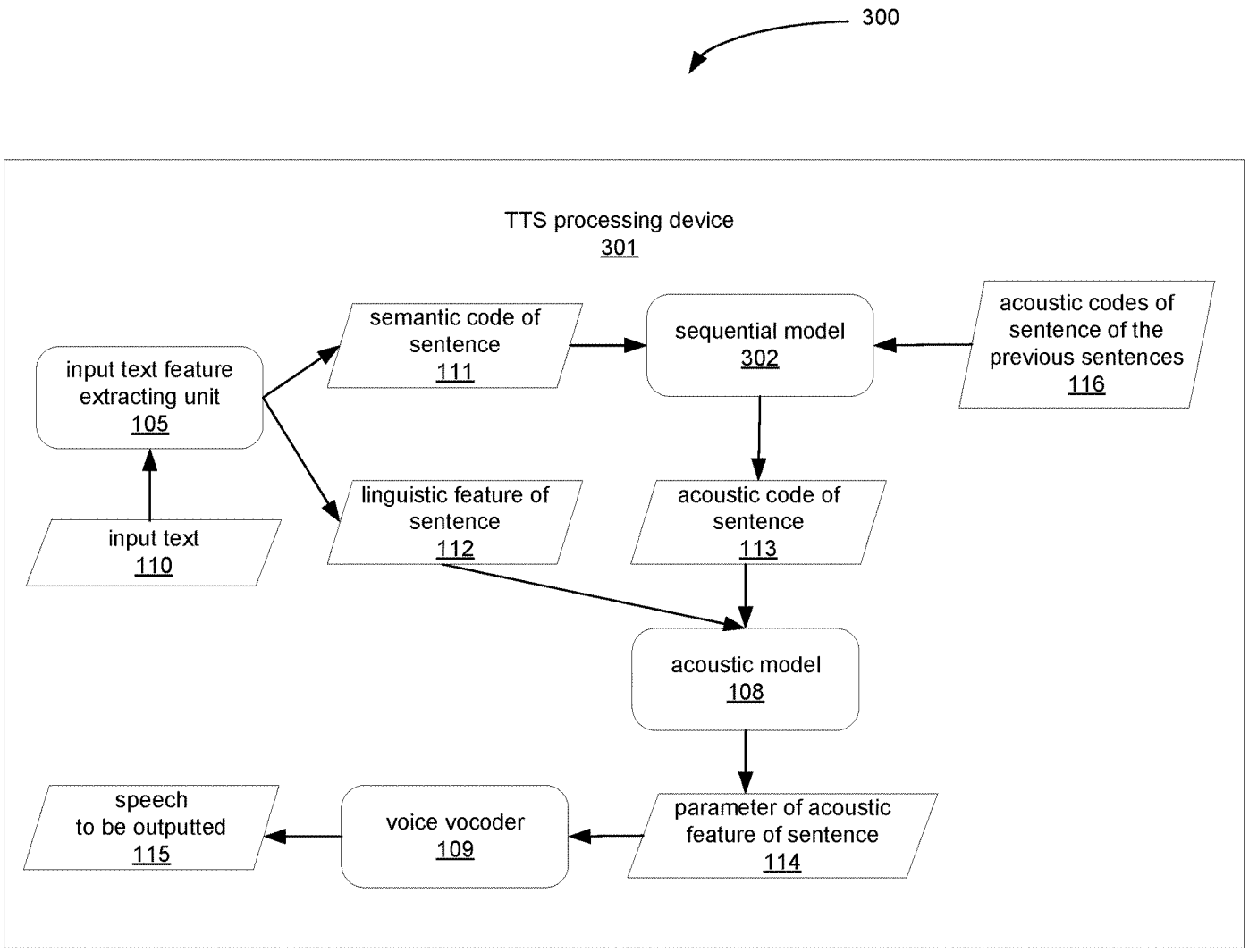
FIG. 3 is another block diagram showing an exemplary structure of a TTS processing device according to embodiments of the present disclosure.

As shown in FIG. 3, which is another block diagram 300 showing an exemplary structure of a TTS processing device according to embodiments of the present disclosure, a TTS processing device 301 may include an input text feature extracting unit 105, a sequential model 302, an acoustic model 108, and a voice vocoder 109.

The input text feature extracting unit 105 may be configured to extract a text feature from each sentence in an input text 110, and acquire a semantic code of sentence 111 and a linguistic feature of sentence 112 of the each sentence in the input text 110.

The sequential model 302 may be configured to predict the semantic code of sentence of the each sentence in the input text according to the semantic code of sentence 111 of the each sentence in the input text 110, and the acoustic codes of sentence (shown as the acoustic codes of sentence of the previous sentences 116 in the figure) of a preset number of sentences ahead of the each sentence. Some preset values may be assigned to the acoustic codes of sentence of sentences at the beginning of the input text, or the acoustic codes of sentence may be generated in a non-predicted way according to the semantic codes of sentence.

The acoustic model 108 may be configured to generate a parameter of acoustic feature of sentence 114 of the each sentence in the input text according to the acoustic code of sentence 113 and the linguistic feature 112 of sentence of the each sentence in the input text.

The voice vocoder 109 may be configured to generate a speech to be outputted 115 according to the parameter of acoustic feature of sentence 114 of the each sentence in the input text.

The TTS processing device shown in FIG. 3 is similar with the TTS processing device shown in FIG. 1, except that the acoustic code of sentence is predicted by the sequential model 302, rather than be predicted by performing searching in the dictionary of acoustic codes of sentences. The sequential model 302 is obtained by training based on a training text. During the training, training is performed with the semantic code of sentence of the each sentence in the training text and the acoustic code of sentence of a plurality of the foregoing sentences as training features, so that the trained sequential model 302 may have a function of predicting an acoustic code of sentence, and the generated acoustic code of sentence may be naturally changed and transited with the development of the text content.

Training Device for Machine Learning Corresponding to the TTS Processing Device 301

Figure 4:
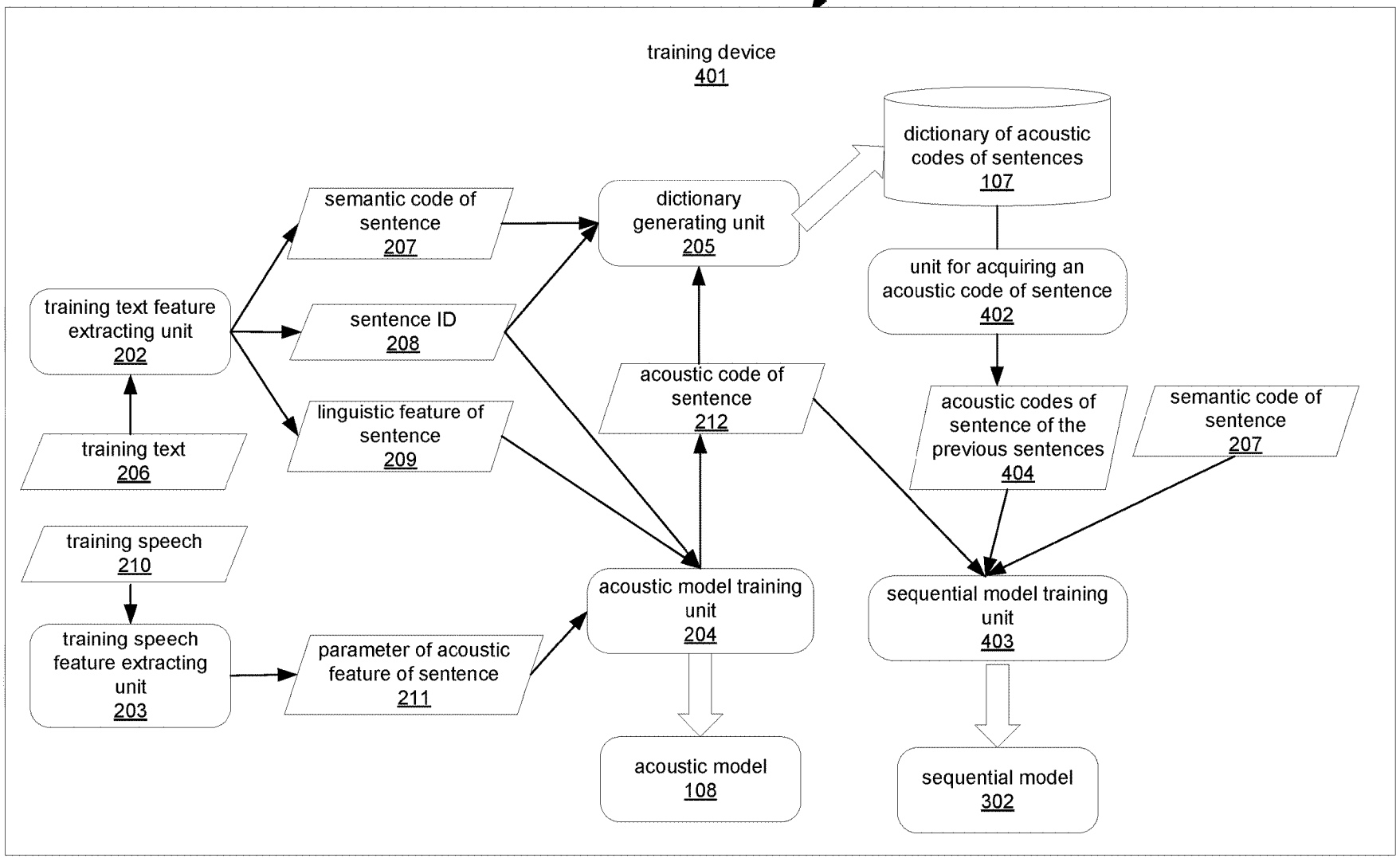
FIG. 4 is a schematic block diagram of a structure of a machine learning training device corresponding to the TTS processing device in FIG. 3.

As shown in FIG. 4, which is a schematic block diagram 400 of a structure of a machine learning training device corresponding to the TTS processing device in FIG. 3, the training device 401 shown in FIG. 4 further includes a unit for acquiring an acoustic code of sentence 402 and a sequential model training unit 403, compared with the training device 201 shown in FIG. 2.

The unit for acquiring an acoustic code of sentence 402 may be configured to acquire acoustic codes of sentence (shown as acoustic codes of sentence of the previous sentences 404 in the figure) of a preset number of sentences ahead of the each sentence. More particularly, in the training device 401, the dictionary of acoustic codes of sentences 107 may be first generated, and then the acoustic codes of sentence of the preset number of sentences ahead of the each sentence may be acquired based on the dictionary of acoustic codes of sentences 107. The dictionary of acoustic codes of sentences 107 may not be generated, and only the acoustic codes of sentence of the preset number of sentences ahead of the each sentence may be recorded to facilitate subsequent sentence training.

The sequential model training unit 403 is used for inputting the semantic code of sentence 207 of the each sentence, the acoustic code of sentence 212, and the acoustic codes of sentence (expressed as acoustic codes of sentence of the previous sentences 404 in the figure) of the preset number of sentences ahead of the each sentence into a sequential training model as second training data, to perform training and generate a trained sequential model 302.

It may be seen from the training processing performed by the training device 301 that, the sequential model 302 generated by the training processing may not only generate the semantic code of sentence based on the semantic code of sentence of a sentence, but also perform prediction according to the pervious acoustic code of sentence, so that the generated speech to be outputted may be naturally changed and transited in rhythm with the development of the input text.

Exemplary Structure of a TTS Processing Device

Figure 5:
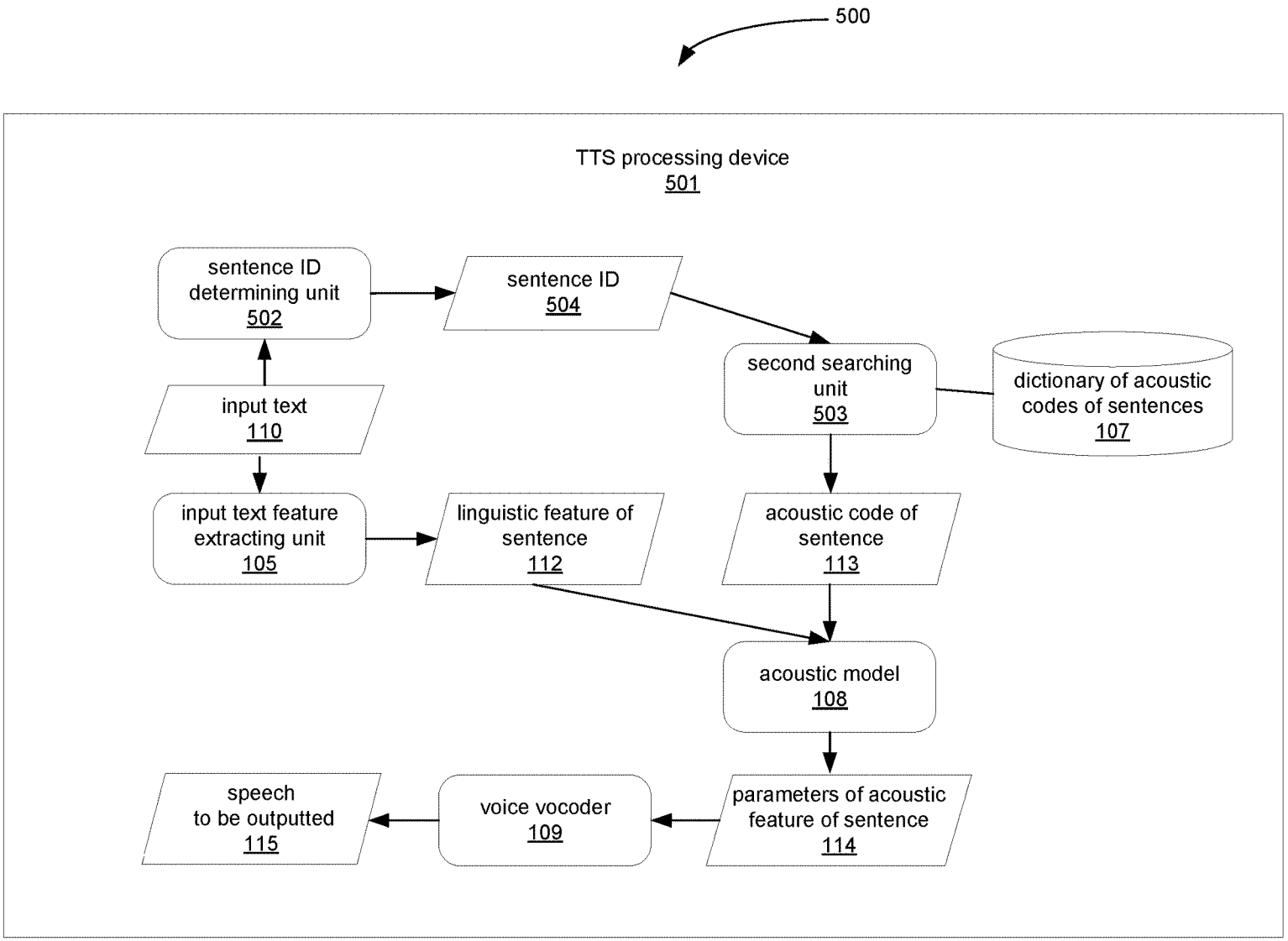
FIG. 5 is another block diagram showing an exemplary structure of a TTS processing device according to embodiments of the present disclosure.

As shown in FIG. 5, which is another block diagram 500 showing an exemplary structure of a TTS processing device according to embodiments of the present disclosure, a TTS processing device 501 may include an input text feature extracting unit 105, a sentence ID determining unit 502, a second searching unit 503, an acoustic model 108, and a voice vocoder 109. The TTS processing device 501 may be similar with the TTS processing device 101 shown in FIG. 1 except that the TTS processing device 501 may acquire an acoustic code of sentence in the dictionary of acoustic codes of sentences 107 according to a sentence ID, and the acquiring on the acoustic code of sentence may be done by the sentence ID determining unit 502 and the second searching unit 503.

More particularly, the input text feature extracting unit 105 shown in FIG. 5 may only extract the linguistic feature of sentence 112 without the need of extracting the semantic code of sentence.

The sentence ID determining unit 502 may be configured to determine a sentence ID 504 corresponding to the each sentence in the input text according to position information of the each sentence in the input text, in connection with a training text template matched with the dictionary of acoustic codes of sentences. The number of sentences in the input text may be different from the number of sentences in the training text as the template, and the sentence ID 504 corresponding to the each sentence in the input text may be acquired by interpolation calculation. For example, the number of sentences in the training text as template may be 100, while the number of sentences in the input text may be 50. The first sentence in the input text corresponds to the first sentence in the training text template, the second sentence in the input text corresponds to the fourth sentence in the training text template, the third sentence in the input text corresponds to the sixth sentence in the training text template, and so on, and the interpolation between sentence numbers in the input text may be changed from the 1 to 2, so as to establish a corresponding relationship between sentences in the input text and sentences in the training text, and thus the sentence IDs corresponding to the sentences in the input text may be determined.

The second searching unit 503 may be configured to perform searching in the dictionary of acoustic codes of sentences 107 according to the sentence ID 504 corresponding to the each sentence in the input text, and acquire an acoustic code of sentence 113 corresponding to the sentence ID 504. The dictionary of acoustic codes of sentences includes a plurality of items consisted of semantic codes of sentence, IDs of sentence, and acoustic codes of sentence, which have mapping relationship therebetween.

Training Device for Machine Learning Corresponding to the TTS Processing Device 501

The dictionary of acoustic codes of sentences 107 and the acoustic model 108 used in the TTS processing device 501 may be same as those used in the TTS processing device 101. Therefore, the training device 201 corresponding to the TTS processing device 101 may be used to perform training on the machine learning model.

Exemplary Structure of Acoustic Model

Figure 6:
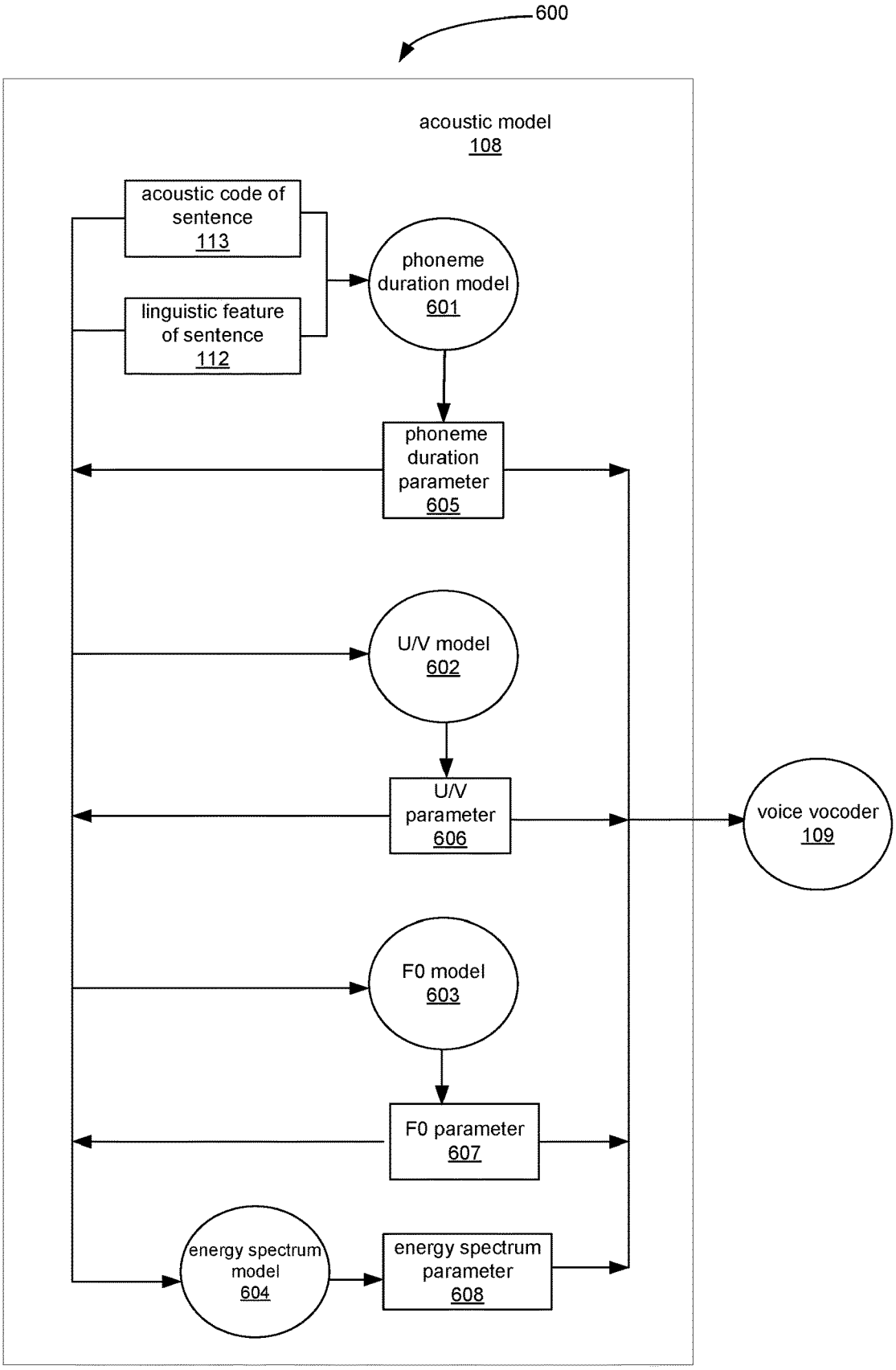
FIG. 6 is a structural block diagram of an exemplary acoustic model according to embodiments of the present disclosure.

As shown in FIG. 6, which is a structural block diagram 600 of an exemplary acoustic model according to embodiments of the present disclosure, the acoustic model in each of the above examples may include: a phoneme duration model 601, a U/V model 602, an F0 model 603, and an energy spectrum model 604. Accordingly, the parameter of acoustic feature of sentence may include a phoneme duration parameter, a U/V parameter, an F0 parameter, and an energy spectrum parameter.

More particularly, the phoneme duration may refer to a phoneme duration of each phoneme in a sentence. The U/V parameter (Unvoice/Voice parameter) may refer to a parameter identifying whether or not each speech frame in a sentence pronounces (whether each speech frame in a sentence is unvoiced or voiced). The F0 parameter may refer to a parameter on tone (pitch or fundamental frequency) of each speech frame in a sentence. The energy spectrum parameter may refer to a parameter on a formation of energy spectrum of each speech frame in a sentence. The phoneme duration parameter, the U/V parameter, and the F0 parameter may be associated with the rhythm of the speech to be outputted, while the energy spectrum parameter may be associated with the tone of the speech to be outputted.

The phoneme duration model 601 may be configured to generate a phoneme duration parameter 605 of the each sentence in the input text according to the acoustic code of sentence 113 and the linguistic feature of sentence 112 of the each sentence in the input text.

The U/V model 602 may be configured to generate a U/V parameter 606 of the each sentence in the input text according to the phoneme duration parameters 605, the acoustic codes of sentence 113, and the linguistic features of sentence 112 of the each sentence in the input text.

The F0 model 603 may be configured to generate an F0 parameter 607 of the each sentence in the input text according to the phoneme duration parameters 605, the U/V parameters 606, the acoustic codes of sentence 113, and the linguistic features of sentence 112 of the each sentence in the input text.

The energy spectrum model 604 may be configured to generate an energy spectrum parameter 608 of the each sentence in the input text according to the phoneme duration parameters 605, the U/V parameters 606, the F0 parameters 607, the acoustic codes of sentence 113, and the linguistic features of sentence 112 of the each sentence in the input text.

Exemplary Structure of Acoustic Model

Figure 7:
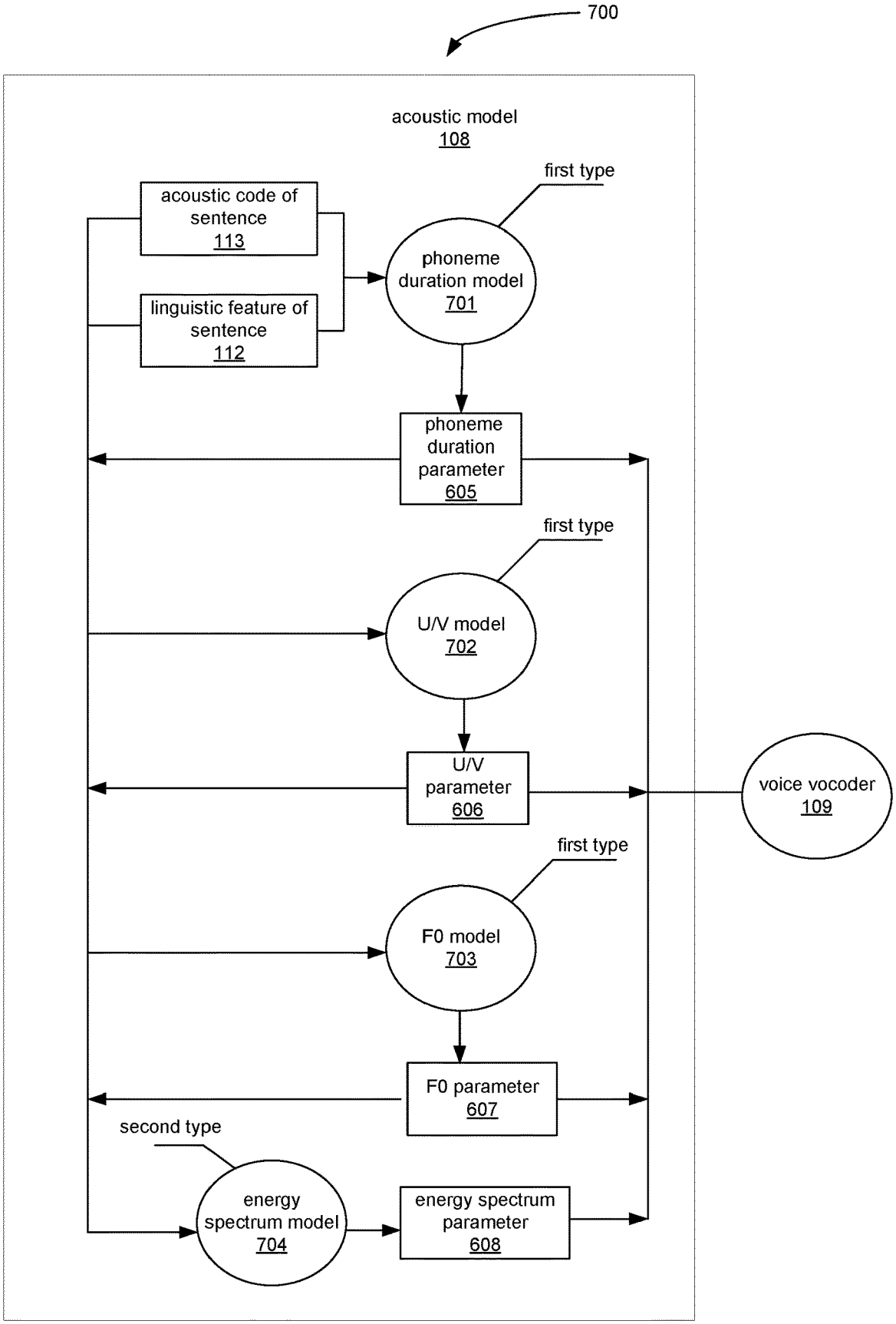
FIG. 7 is a structural block diagram of another exemplary acoustic model according to embodiments of the present disclosure.

As shown in FIG. 7, which is a structural block diagram 700 of another exemplary acoustic model according to embodiments of the present disclosure, the acoustic model shown in FIG. 7 may be similar with the acoustic model shown in FIG. 6, except that the phoneme duration model 701, the U/V model 702 and the F0 model 703 shown in FIG. 7 may be models generated by a training processing based on a first type of training speech, and the energy spectrum model 704 may be a model generated by a training processing based on a second type of training speech.

As described hereinbefore, the phoneme duration parameter, the U/V parameter, and the F0 parameter may be associated with the rhythm of the speech to be outputted, while the energy spectrum parameter may be associated with the tone of the speech to be outputted. In the example shown in FIG. 7, in the case that same training documents are used, the phoneme duration model 701, the U/V model 702, and the F0 model 703 may be generated by a training processing with a voice of a character A as a training speech, and the energy spectrum model 704 may be generated by a training processing with a voice of a character B as a training speech, so as to implement the generating of a speech to be outputted by using the rhythm of the character A in combination with the tone of the character B.

Illustrative Processing

Figure 8:
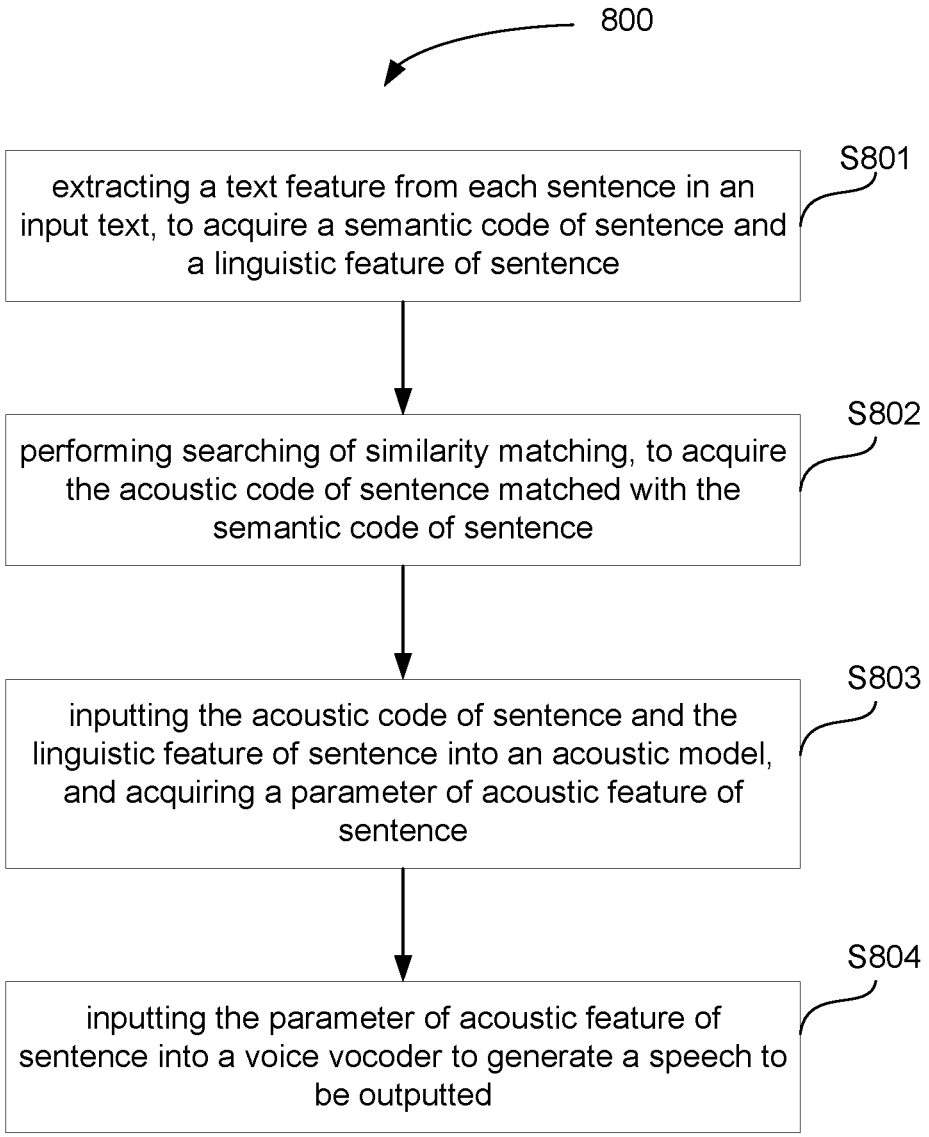
FIG. 8 is a schematic flowchart showing a TTS processing method according to embodiments of the present disclosure.

As shown in FIG. 8, which is a schematic flowchart 800 showing a TTS processing method according to embodiments of the present disclosure, the TTS processing method shown in FIG. 8 may correspond to the Way I of performing searching for an acoustic code of sentence in a dictionary of acoustic codes of sentences based on a semantic code of sentence as described above. The TTS processing method may be implemented by the TTS processing device shown in FIG. 1, and may include the following steps.

S801: extracting a text feature from each sentence in an input text, to acquire a semantic code of sentence and a linguistic feature of sentence of the each sentence in the input text.

S802: performing searching of similarity matching in the dictionary of acoustic codes of sentences according to the semantic code of sentence of the each sentence in the input text, to acquire the acoustic code of sentence matched with the semantic code of sentence. The dictionary of acoustic codes of sentences may include a plurality of items consisted of semantic codes of sentence, IDs of sentence, and acoustic codes of sentence, which have mapping relationship therebetween.

In view of a plurality of situations in which a plurality of matched items may be found, the step of S802 may particularly include: performing searching of similarity matching in the dictionary of acoustic codes of sentences according to the semantic code of sentence of the each sentence in the input text and the semantic codes of sentence of a preset number of sentences in context of the each sentence in the input text, to acquire an acoustic code of sentence matched with the semantic code of sentence of the each sentence in the input text. It should be noted that the above way of performing searching with the semantic code of sentence of the current sentence and the semantic code of sentence of the sentence in the context combined with each other may be performed from the beginning rather than only after a plurality of matched items are found. For example, different weight values may be assigned to the semantic code of sentence of the current sentence and the semantic codes of sentence of the sentences in the context. Then the overall similarity between the sentence and the sentences in the context and the sentences in the dictionary of acoustic codes of sentences is calculated, so as to perform ranking according to the overall similarity and select the sentence with highest ranking as the searching result.

In addition, considering the above situation of finding a plurality of matched items, the step of S802 may further include the following steps: determining a sentence ID corresponding to each sentence in the input text according to a position information of each sentence in an input text in connection with a training text template matched with the dictionary of acoustic codes of sentences; performing similarity match searching in the dictionary of acoustic codes of sentences according to the semantic code of sentence and the determined sentence ID of the each sentence in the input text, and acquiring the acoustic code of sentence matched with the semantic code of sentence of the each sentence in the input text.

S803: inputting the acoustic code of sentence and the linguistic feature of sentence of the each sentence in the input text into an acoustic model, and acquiring a parameter of acoustic feature of sentence of the each sentence in the input text. More particularly, the acoustic model includes a phoneme duration model, a U/V model, an F0 model, and an energy spectrum model, and the parameter of acoustic feature of sentence may include a phoneme duration parameter, a U/V parameter, an F0 parameter, and an energy spectrum parameter.

Accordingly, in the step of S803, the inputting the acoustic code of sentence and the linguistic feature of sentence of the each sentence in the input text into an acoustic model, and acquiring a parameter of acoustic feature of sentence of the each sentence in the input text includes: inputting the acoustic code of sentence and the linguistic feature of sentence of the each sentence in the input text into the phoneme duration model, to acquire a phoneme duration parameter of the each sentence in the input text; inputting the phoneme duration parameter, the acoustic code of sentence, and the linguistic feature of sentence of the each sentence in the input text into the U/V model, to acquire the U/V parameter of the each sentence in the input text; inputting the phoneme duration parameter, the U/V parameter, the acoustic code of sentence, and the linguistic feature of sentence of the each sentence in the input text into the F0 model, to acquire the F0 parameter of the each sentence in the input text; and inputting the phoneme duration parameter, the U/V parameter, the F0 parameter, the acoustic code of sentence, and the linguistic feature of sentence of the each sentence in the input text into the energy spectrum model, to acquire the energy spectrum parameter of the each sentence in the input text.

Furthermore, the generating a parameter of acoustic feature of sentence may further include a step of S804 of inputting the parameter of acoustic feature of sentence of the each sentence in the input text into a voice vocoder to generate a speech to be outputted.

Figure 9:
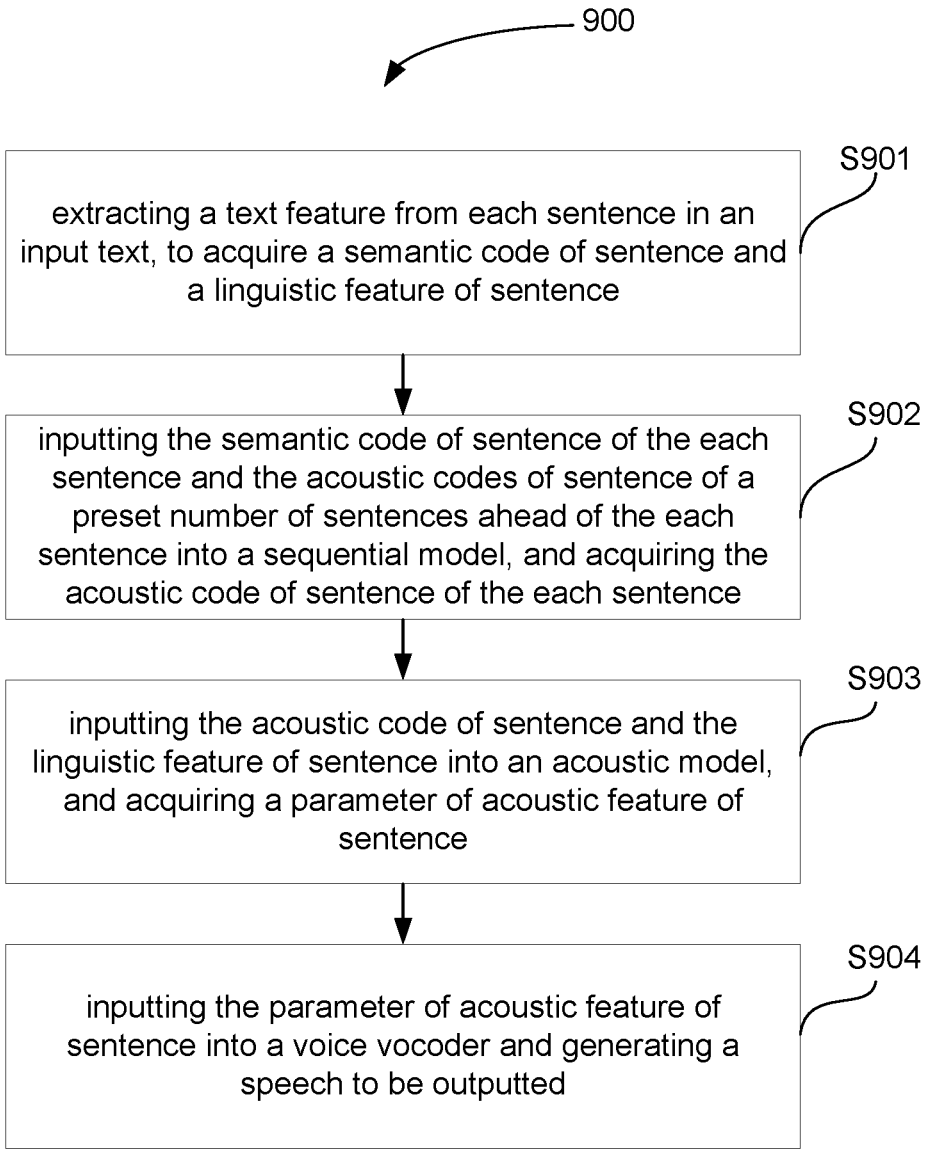
FIG. 9 is a schematic flowchart showing another TTS processing method according to embodiments of the present disclosure.

As shown in FIG. 9, which is a schematic flowchart 900 showing another TTS processing method according to embodiments of the present disclosure, the TTS processing method shown in FIG. 9 may correspond to the Way II of performing prediction of an acoustic code of sentence based on the sequential model as described above. The TTS processing method may be accomplished by the TTS processing device shown in FIG. 3. The TTS processing method may include the following steps.

S901: extracting a text feature from each sentence in an input text, and acquiring a semantic code of sentence and a linguistic feature of sentence of the each sentence in the input text.

S902: inputting the semantic code of sentence of the each sentence in the input text and the acoustic codes of sentence of a preset number of sentences ahead of the each sentence in the input text into a sequential model, and acquiring the acoustic code of sentence of the each sentence in the input text. Some preset values may be assigned to the acoustic codes of sentence of sentences at the beginning of the input text, or the acoustic codes of sentence may be generated in a non-predicted way according to the semantic codes of sentence.

S903: inputting the acoustic code of sentence and the linguistic feature of sentence of the each sentence in the input text into an acoustic model, and acquiring a parameter of acoustic feature of sentence of the each sentence in the input text. The processing described with FIG. 7 may be employed for the processing of acquiring a parameter of acoustic feature of sentence of the each sentence in the input text performed based on various internal structures of the acoustic model.

Furthermore, the generating a parameter of acoustic feature of sentence may further include the following step.

S904: inputting the parameter of acoustic feature of sentence of the each sentence in the input text into a voice vocoder and generating a speech to be outputted.

Figure 10:
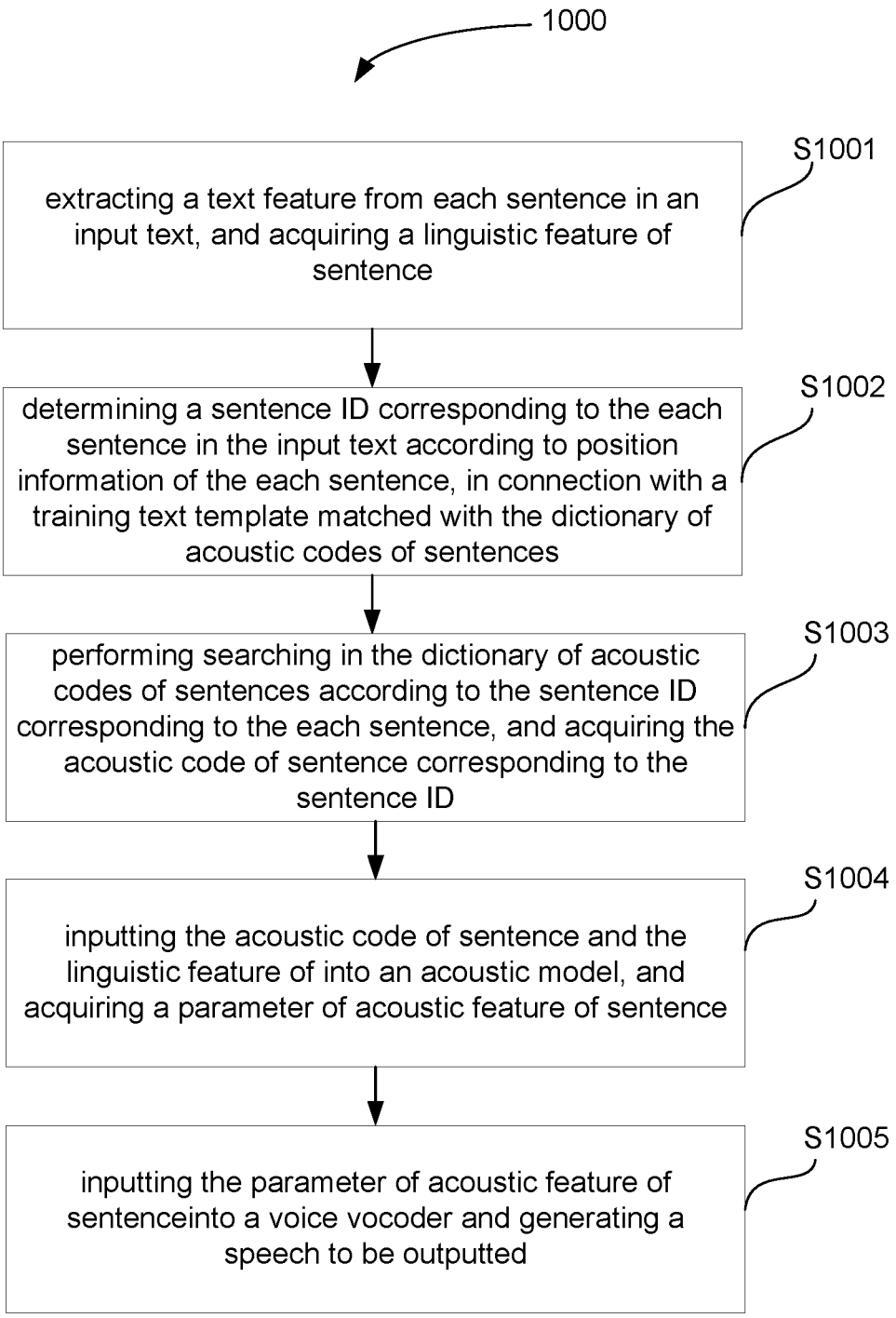
FIG. 10 is a schematic flowchart showing another TTS processing method according to embodiments of the present disclosure.

As shown in FIG. 10, which is a schematic flowchart 1000 showing another TTS processing method according to embodiments of the present disclosure, the TTS processing method shown in FIG. 10 may correspond to the above Way III of performing search for an acoustic code of sentence in a dictionary of acoustic codes of sentences based on a sentence ID. The TTS processing method may be implemented by the TTS processing device shown in FIG. 5. The TTS processing method may include the following steps.

S1001: extracting a text feature from each sentence in an input text, and acquiring a linguistic feature of sentence of the each sentence in the input text.

S1002: determining a sentence ID corresponding to the each sentence in the input text according to position information of the each sentence in the input text, in connection with a training text template matched with the dictionary of acoustic codes of sentences. There may be difference between the number of sentences in the input text and the number of sentences in the training text as the template, and the corresponding sentence ID may be acquired by interpolation calculation.

S1003: performing searching in the dictionary of acoustic codes of sentences according to the sentence ID corresponding to the each sentence in the input text, and acquiring the acoustic code of sentence corresponding to the sentence ID. The dictionary of acoustic codes of sentences may include a plurality of items consisted of semantic codes of sentence, IDs of sentence, and acoustic codes of sentence, which have mapping relationship therebetween.

S1004: inputting the acoustic code of sentence and the linguistic feature of sentence of the each sentence in the input text into an acoustic model, and acquiring a parameter of acoustic feature of sentence of the each sentence in the input text. The processing described with FIG. 7 may be employed for the processing of acquiring a parameter of acoustic feature of sentence of the each sentence in the input text performed based on the specific internal structure of the acoustic model.

Furthermore, the generating a parameter of acoustic feature of sentence may further include the following step.

S1005: inputting the parameter of acoustic feature of sentence of the each sentence in the input text into a voice vocoder and generating a speech to be outputted.

Figure 11:
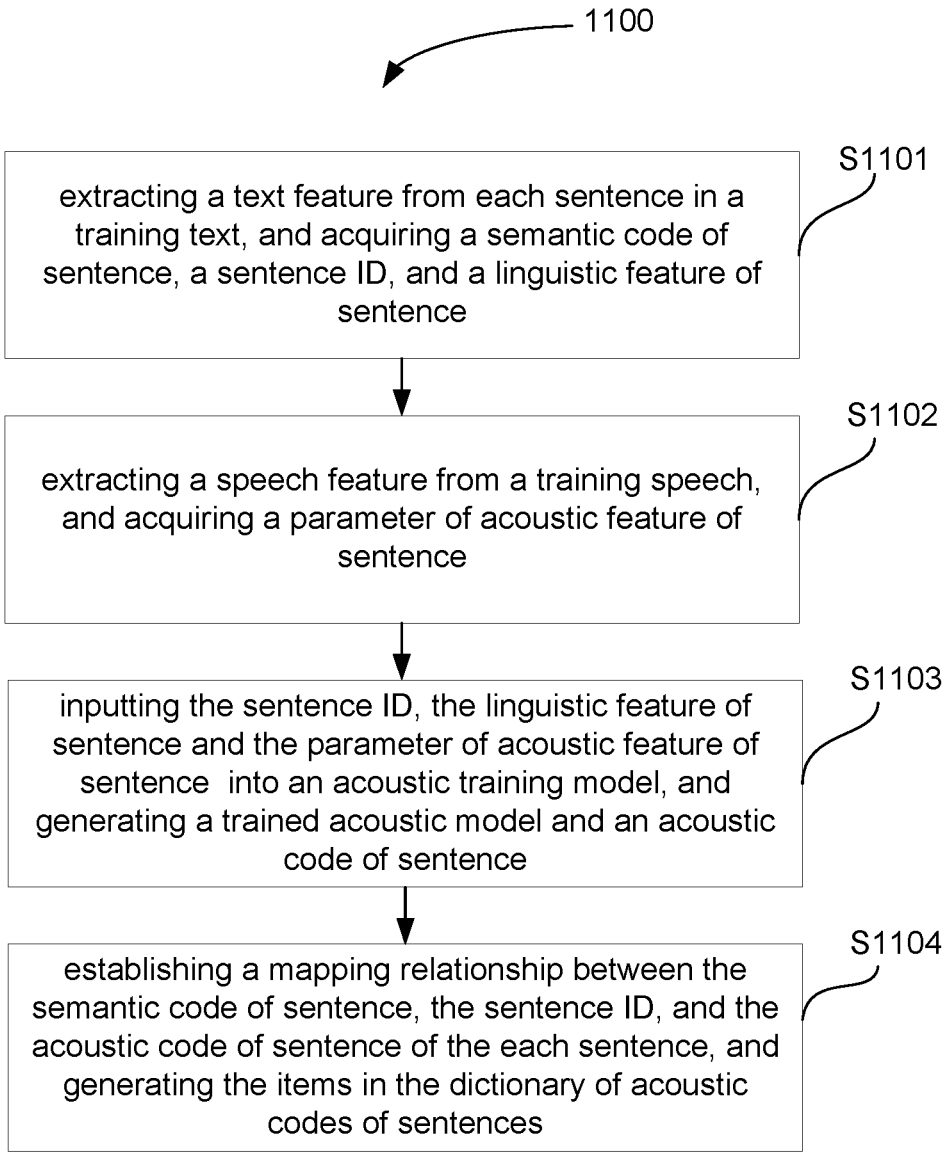
FIG. 11 is a schematic flowchart showing a training method for machine learning according to embodiments of the present disclosure.

As shown in FIG. 11, which is a schematic flowchart 1100 showing a training method for machine learning according to embodiments of the present disclosure, the acoustic model trained by using the training method shown in FIG. 11 and the dictionary of acoustic codes of sentences may be applied in the TTS processing method shown in the above FIG. 8 and FIG. 10. The TTS processing method shown in FIG. 11 may be implemented by the machine learning device shown in FIG. 2. The TTS processing method may include the following steps.

S1101: extracting a text feature from each sentence in a training text, and acquiring a semantic code of sentence, a sentence ID, and a linguistic feature of sentence of the each sentence.

S1102: extracting a speech feature from a training speech, and acquiring a parameter of acoustic feature of sentence of the each sentence.

S1103: inputting the sentence ID of the each sentence, the linguistic feature of sentence and the parameter of acoustic feature of sentence of the each sentence into an acoustic training model as first training data, and generating a trained acoustic model and an acoustic code of sentence of the each sentence.

S1104: establishing a mapping relationship between the semantic code of sentence, the sentence ID, and the acoustic code of sentence of the each sentence, and generating the items in the dictionary of acoustic codes of sentences.

Figure 12:
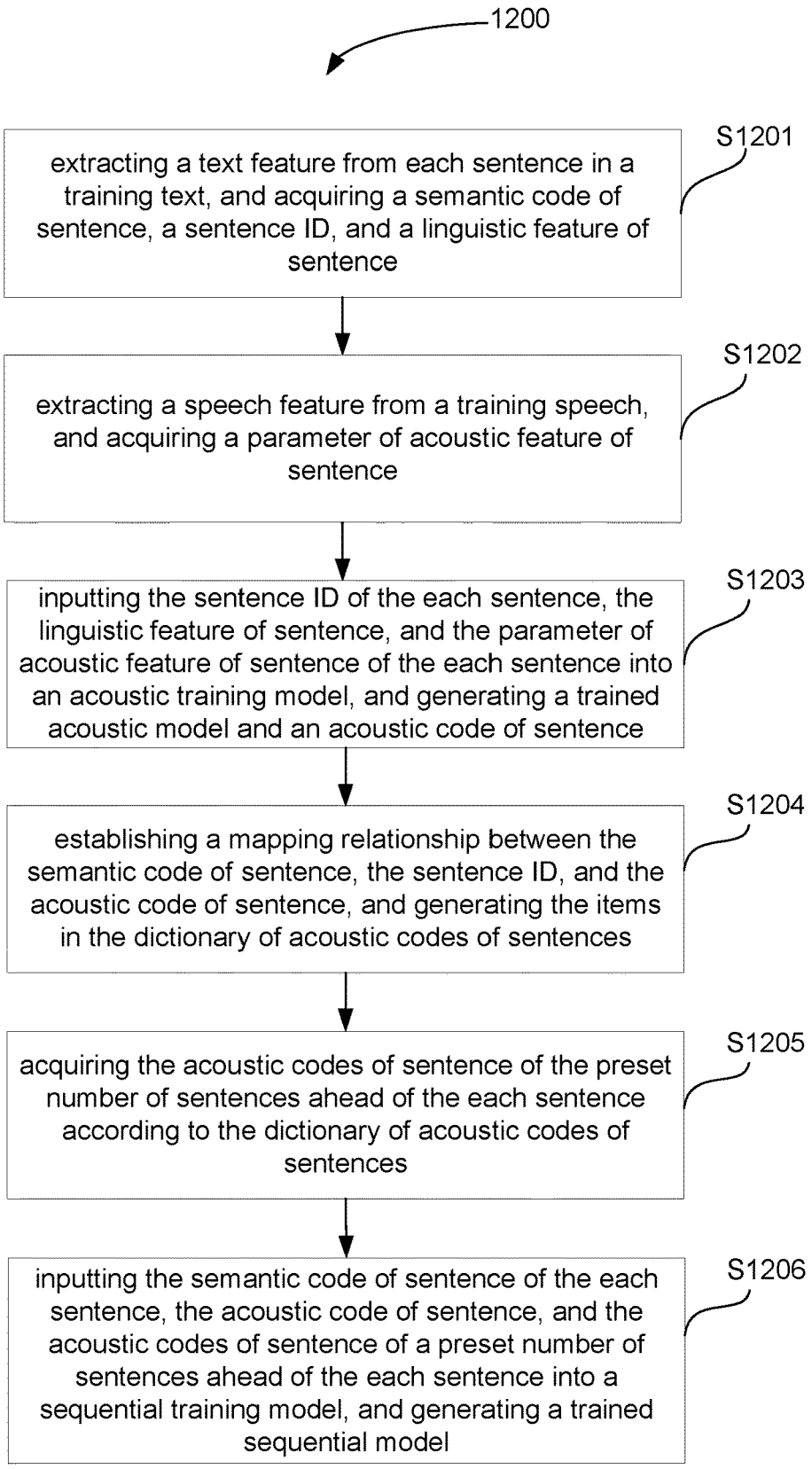
FIG. 12 is a schematic flowchart showing another training method for machine learning according to embodiments of the present disclosure.

As shown in FIG. 12, which is a schematic flowchart 1200 showing another training method for machine learning according to embodiments of the present disclosure, the acoustic model trained by using the training method for machine learning shown in FIG. 12 and the dictionary of acoustic codes of sentences may be applied in the TTS processing method in the above FIG. 9. The training method for machine learning shown in FIG. 12 may be implemented by the machine learning device shown in FIG. 4. The training method for machine learning may include the following steps.

S1201: extracting a text feature from each sentence in a training text, and acquiring a semantic code of sentence, a sentence ID, and a linguistic feature of sentence of the each sentence.

S1202: extracting a speech feature from a training speech, and acquiring a parameter of acoustic feature of sentence of the each sentence.

S1203: inputting the sentence ID of the each sentence, the linguistic feature of sentence, and the parameter of acoustic feature of sentence of the each sentence into an acoustic training model as first training data, and generating a trained acoustic model and an acoustic code of sentence of the each sentence via a training processing.

S1204: establishing a mapping relationship between the semantic code of sentence, the sentence ID, and the acoustic code of sentence of the each sentence, and generating the items in the dictionary of acoustic codes of sentences.

S1205: acquiring the acoustic codes of sentence of the preset number of sentences ahead of the each sentence according to the dictionary of acoustic codes of sentences.

S1206: inputting the semantic code of sentence of the each sentence, the acoustic code of sentence, and the acoustic codes of sentence of a preset number of sentences ahead of the each sentence into a sequential training model as second training data, and generating a trained sequential model.

The training method for machine learning shown in FIG. 12 may perform a buffering recording on the acoustic codes of sentence of a certain number of the previous sentences in the processing of generating acoustic codes of sentence of the each sentence for subsequent sentence training, instead of the processing of generating the dictionary of acoustic codes of sentences in the step of S1204 and the processing of acquiring the acoustic codes of sentence of the previous sentences based on the dictionary of acoustic codes of sentences in the step of S1206.

It should be noted that, the TTS processing method and the training method corresponding thereto described above may be implemented based on the above TTS processing device and training device, or implemented independently as a procedure of processing method, or implemented by using other software or hardware design under the technical idea of the embodiments of the present disclosure.

Description has been made on the processes of the answer-in-song processing methods according to the embodiments of the invention in the above, and the technical details and corresponding technical effects thereof are described in detail in the preceding introduction on the processing devices, and repeated description may be omitted to avoid redundancy.

Implementation Example of Electronic Apparatus

The electronic apparatus according to embodiments of the present disclosure may be a mobile electronic apparatus, or an electronic apparatus with less mobility or a stationary computing apparatus. The electronic apparatus according to embodiments of the present disclosure may at least include a processor and a memory. The memory may store instructions thereon and the processor may obtain instructions from the memory and execute the instructions to cause the electronic apparatus to perform operations.

In some examples, one or more components or modules and one or more steps as shown in FIG. 1 to FIG. 12 may be implemented by software, hardware, or in combination of software and hardware. For example, the above component or module and one or more steps may be implemented in system on chip (SoC). Soc may include: integrated circuit chip, including one or more of processing unit (such as center processing unit (CPU), micro controller, micro processing unit, digital signal processing unit (DSP) or the like), memory, one or more communication interface, and/or other circuit for performing its function and alternative embedded firmware.

Figure 13:
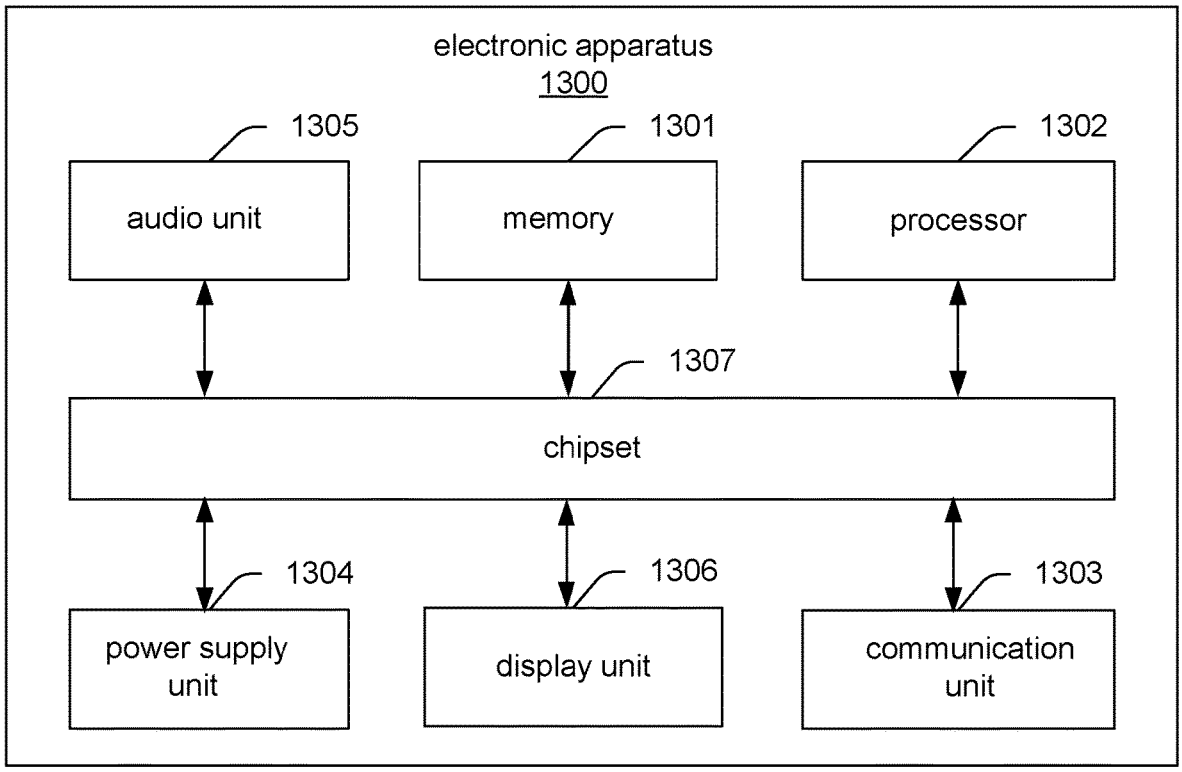
FIG. 13 is a structural block diagram of an exemplary mobile electronic apparatus.

As shown in FIG. 13, which is a structural block diagram of an exemplary mobile electronic apparatus 1300. The electronic apparatus 133 may be a small portable (or mobile) electronic apparatus. The small portable (or mobile) electronic apparatus may be e.g., a cell phone, a personal digital assistant (PDA), a personal media player device, a wireless network player device, personal headset device, an IoT (internet of things) intelligent device, a dedicate device or combined device containing any of functions described above. The electronic apparatus 1300 may at least include a memory 1301 and a processor 1302.

The memory 1301 may be configured to store programs. In addition to the above programs, the memory 1301 may be configured to store other data to support operations on the electronic apparatus 1300. The examples of these data may include instructions of any applications or methods operated on the electronic apparatus 1300, contact data, phone book data, messages, pictures, videos, and the like.

The memory 1301 may be implemented by any kind of volatile or nonvolatile storage device or their combinations, such as static random access memory (SRAM), electronically erasable programmable read-only memory (EEPROM), erasable programmable read-only memory (EPROM), programmable read-only memory (PROM), read-only memory (ROM), magnetic memory, flash memory, disk memory, or optical disk.

The memory 1301 may be coupled to the processor 1302 and contain instructions stored thereon. The instructions may cause the electronic apparatus 1300 to perform operations upon being executed by the processor 1302, the operations may include: implement the related processing procedures performed in the corresponding examples shown in FIG. 8 to FIG. 12, or processing logics performed by the TTS processing device shown in FIG. 1 to FIG. 7.

Detailed description has been made on the above operations in the above embodiments of method and device. The description on the above operations may be applied to electronic apparatus 1300. That is to say, the specific operations mentioned in the above embodiments may be recorded in memory 1301 in program and be performed by processor 1302.

Furthermore, as shown in FIG. 13, the electronic apparatus 1300 may further include: a communication unit 1303, a power supply unit 1304, an audio unit 1305, a display unit 1306, chipset 1307, and other units. Only part of units are exemplarily shown in FIG. 13 and it is obvious to one skilled in the art that the electronic apparatus 1300 only includes the units shown in FIG. 13.

The communication unit 1303 may be configured to facilitate wireless or wired communication between the electronic apparatus 1300 and other apparatuses. The electronic apparatus may be connected to wireless network based on communication standard, such as WiFi, 2G, 3G, or their combination. In an exemplary example, the communication unit 1303 may receive radio signal or radio related information from external radio management system via radio channel. In an exemplary example, the communication unit 1303 may further include near field communication (NFC) module for facilitating short-range communication. For example, the NFC module may be implemented with radio frequency identification (RFID) technology, Infrared data association (IrDA) technology, ultra wideband (UWB) technology, Bluetooth (BT) technology and other technologies.

The power supply unit 1304 may be configured to supply power to various units of the electronic device. The power supply unit 1304 may include a power supply management system, one or more power supplies, and other units related to power generation, management, and allocation.

The audio unit 1305 may be configured to output and/or input audio signals. For example, the audio unit 1305 may include a microphone (MIC). When the electronic apparatus in an operation mode, such as calling mode, recording mode, and voice recognition mode, the MIC may be configured to receive external audio signals. The received audio signals may be further stored in the memory 1301 or sent via the communication unit 1303. In some examples, the audio unit 1305 may further include a speaker configured to output audio signals.

The display unit 1306 may include a screen, which may include liquid crystal display (LCD) and touch panel (TP). If the screen includes a touch panel, the screen may be implemented as touch screen so as to receive input signal from users. The touch panel may include a plurality of touch sensors to sense touching, sliding, and gestures on the touch panel. The touch sensor may not only sense edges of touching or sliding actions, but also sense period and pressure related to the touching or sliding operations.

The above memory 1301, processor 1302, communication unit 1303, power supply unit 1304, audio unit 1305 and display unit 1306 may be connected with the chipset 1307. The chipset 1307 may provide interface between the processor 1302 and other units of the electronic apparatus 1300. Furthermore, the chipset 1307 may provide interface for each unit of the electronic apparatus 1300 to access the memory 1301 and communication interface for accessing among units.

In some examples, one or more modules, one or more steps, or one or more processing procedures involved in FIGS. 1 to 12 may be implemented by a computing device with an operating system and hardware configuration.

Figure 14:
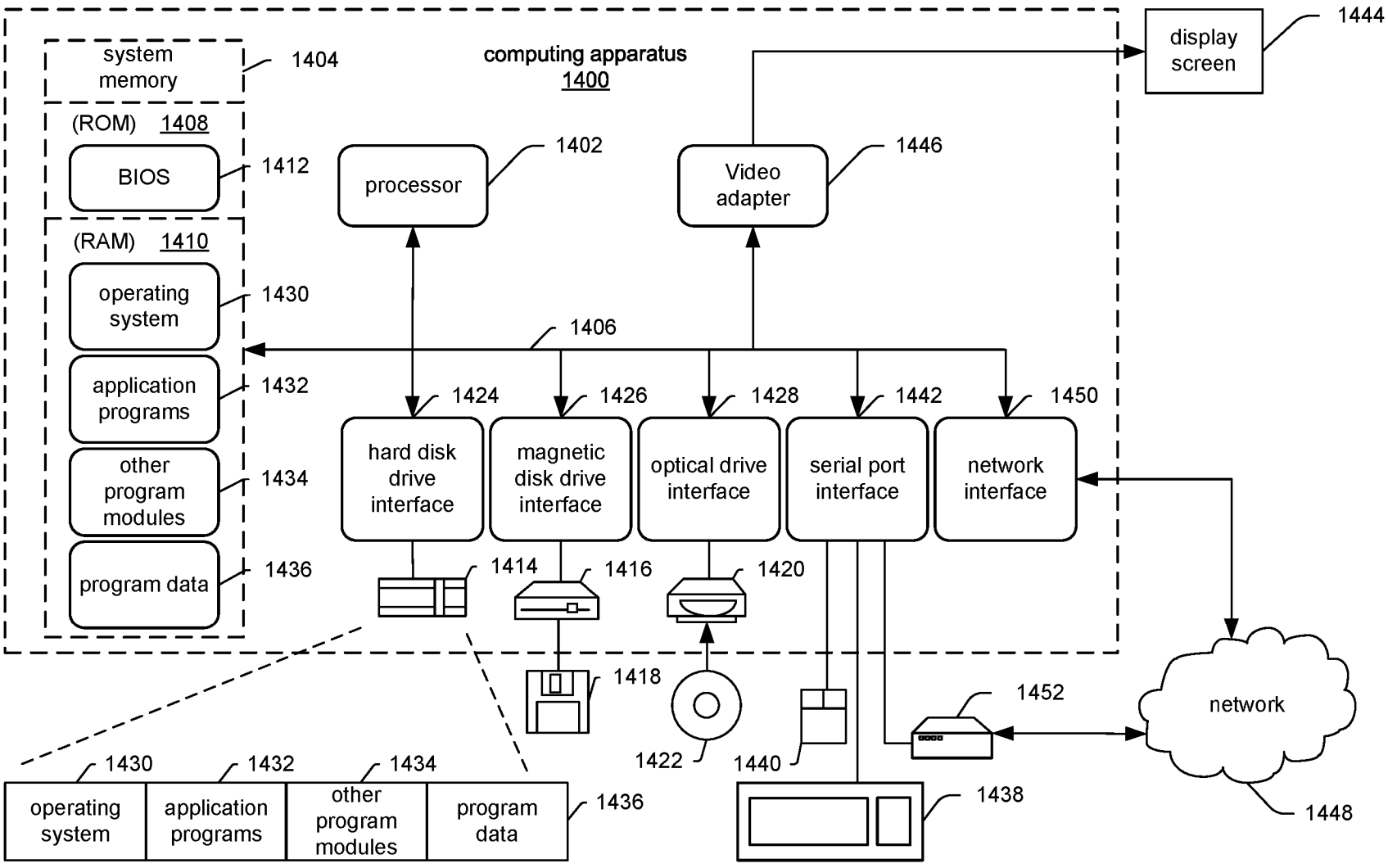
FIG. 14 is a structural block diagram of an exemplary computing apparatus.

FIG. 14 is a structural block diagram of an exemplary computing apparatus 1400. The description of computing apparatus 1400 provided herein is provided for purposes of illustration, and is not intended to be limiting. Embodiments may be implemented in further types of computer systems, as would be known to persons skilled in the relevant art(s).

As shown in FIG. 14, the computing apparatus 1400 includes one or more processors 1402, a system memory 1404, and a bus 1406 that couples various system components including system memory 1404 to processor 1402. Bus 1406 represents one or more of any of several types of bus structures, including a memory bus or memory controller, a peripheral bus, an accelerated graphics port, and a processor or local bus using any of a variety of bus architectures. System memory 1404 includes read only memory (ROM) 1408, and random access memory (RAM) 1410. A basic input/output system 1412 (BIOS) is stored in ROM 1408.

The computing apparatus 1400 also has one or more of the following drives: a hard disk drive 1414 for reading from and writing to a hard disk, a magnetic disk drive 1416 for reading from or writing to a removable magnetic disk 1418, and an optical disk drive 1420 for reading from or writing to a removable optical disk 1422 such as a CD ROM, DVD ROM, or other optical media. Hard disk drive 1414, magnetic disk drive 1416, and optical disk drive 1420 are connected to bus 1406 by a hard disk drive interface 1424, a magnetic disk drive interface 1426, and an optical drive interface 1428, respectively. The drives and their associated computer-readable media provide nonvolatile storage of computer-readable instructions, data structures, program modules and other data for the computer. Although a hard disk, a removable magnetic disk and a removable optical disk are described, other types of computer-readable storage media can be used to store data, such as flash memory cards, digital video disks, RAMs, ROMs, and the like.

A number of program modules may be stored on the hard disk, magnetic disk, optical disk, ROM, or RAM. These programs include an operating system 1430, one or more application programs 1432, other program modules 1434, and program data 1436. These programs may include, for example, computer program logic (e.g., computer program code or instructions) for implementing processing procedures performed in the corresponding examples shown in FIG. 8 to FIG. 12, or processing logics performed by the TTS processing device shown in FIG. 1 to FIG. 7.

A user may enter commands and information into computing apparatus 1400 through input devices such as a keyboard 1438 and a pointing device 1440. Other input devices (not shown) may include a microphone, joystick, game pad, satellite dish, scanner, a touch screen and/or touch pad, a voice recognition system to receive voice input, a gesture recognition system to receive gesture input, or the like. These and other input devices may be connected to processor 1402 through a serial port interface 1442 that is coupled to bus 1406, but may be connected by other interfaces, such as a parallel port, game port, or a universal serial bus (USB).

A display screen 1444 is also connected to bus 1406 via an interface, such as a video adapter 1446. Display screen 1444 may be external to, or incorporated in computing apparatus 1400. Display screen 1444 may display information, as well as being a user interface for receiving user commands and/or other information (e.g., by touch, finger gestures, virtual keyboard, etc.). In addition to display screen 1444, the computing apparatus 1400 may include other peripheral output devices (not shown) such as speakers and printers.

The computing apparatus 1400 is connected to a network 1448 (e.g., the Internet) through an adaptor or network interface 1450, a modem 1452, or other means for establishing communications over the network. Modem 1452, which may be internal or external, may be connected to bus 1406 via serial port interface 1442, as shown in FIG. 14, or may be connected to bus 1406 using another interface type, including a parallel interface.

As used herein, the terms "computer program medium," "computer-readable medium," and "computer-readable storage medium" are used to generally refer to media such as the hard disk associated with hard disk drive 1414, removable magnetic disk 1418, removable optical disk 1422, system memory 1404, flash memory cards, digital video disks, RAMs, ROMs, and further types of physical/tangible storage media. Such computer-readable storage media are distinguished from and non-overlapping with communication media (do not include communication media). Communication media typically embodies computer-readable instructions, data structures, program modules or other data in a modulated data signal such as a carrier wave. The term "modulated data signal" means a signal that has one or more of its characteristics set or changed in such a manner as to encode information in the signal. By way of example, and not limitation, communication media includes wireless media such as acoustic, RF, infrared and other wireless media, as well as wired media. Embodiments are also directed to such communication media.

As noted above, computer programs and modules (including application programs 1432 and other program modules 1434) may be stored on the hard disk, magnetic disk, optical disk, ROM, or RAM. Such computer programs may also be received via network interface 1450, serial port interface 1442, or any other interface type. Such computer programs, when executed or loaded by an application, enable computing apparatus 1400 to implement features of embodiments discussed herein. Accordingly, such computer programs represent controllers of the computing apparatus 1400.

As such, embodiments are also directed to computer program products including computer instructions/code stored on any computer useable storage medium. Such code/instructions, when executed in one or more data processing devices, causes a data processing device(s) to operate as described herein. Examples of computer-readable storage devices that may include computer readable storage media include storage devices such as RAM, hard drives, floppy disk drives, CD ROM drives, DVD ROM drives, zip disk drives, tape drives, magnetic storage device drives, optical storage device drives, MEMs devices, nanotechnology-based storage devices, and further types of physical/tangible computer readable storage devices.

Example Clauses

A1. A method, including:

extracting a text feature from each sentence in an input text, to acquire a semantic code of sentence and a linguistic feature of sentence of the each sentence in the input text;

performing searching of similarity matching in a dictionary of acoustic codes of sentences according to the semantic code of sentence of the each sentence in the input text, to acquire an acoustic code of sentence matched with the semantic code of sentence of the each sentence, wherein the dictionary of acoustic codes of sentences includes a plurality of items consisted of semantic codes of sentence, IDs of sentence, and acoustic codes of sentence, which have mapping relationship therebetween; and inputting the acoustic code of sentence and the linguistic feature of sentence of the each sentence in the input text into an acoustic model, to acquire a parameter of acoustic feature of sentence of the each sentence in the input text.

A2. The method according to paragraph A1, wherein the performing searching of similarity matching in a dictionary of acoustic codes of sentences according to the semantic code of sentence of the each sentence in the input text, to acquire an acoustic code of sentence matched with the semantic code of sentence of the each sentence includes:

performing searching of similarity matching in a dictionary of acoustic codes of sentences according to the semantic code of sentence of the each sentence in the input text and the semantic code of sentence of a preset number of sentences in context of the each sentence in the input text, to acquire an acoustic code of sentence matched with the semantic code of sentence of the each sentence in the input text.

A3. The method according to paragraph A1, wherein the performing searching of similarity matching in a dictionary of acoustic codes of sentences according to the semantic code of sentence of the each sentence in the input text, to acquire an acoustic code of sentence matched with the semantic code of sentence of the each sentence includes:

determining a sentence ID corresponding to the each sentence in the input text according to position information of the each sentence in the input text, in connection with a training text template matched with the dictionary of acoustic codes of sentences; and performing searching of similarity matching in the dictionary of acoustic codes of sentences according to the semantic code of sentence and the determined sentence ID of the each sentence in the input text, to acquire the acoustic code of sentence matched with the semantic code of sentence of the each sentence in the input text.

A4. The method according to paragraph A1, wherein the acoustic model includes a phoneme duration model, a U/V model, an F0 model and an energy spectrum model, and the parameter of acoustic feature of sentence includes a phoneme duration parameter, a U/V parameter, an F0 parameter, and an energy spectrum parameter, and the inputting the acoustic code of sentence and the linguistic feature of sentence of the each sentence in the input text into an acoustic model, to acquire a parameter of acoustic feature of sentence of the each sentence in the input text includes:

inputting the acoustic code of sentence and the linguistic feature of sentence of the each sentence in the input text into the phoneme duration model, to acquire a phoneme duration parameter of the each sentence in the input text;

inputting the phoneme duration parameter, the acoustic code of sentence, and the linguistic feature of sentence of the each sentence in the input text into the U/V model, to acquire the U/V parameter of the each sentence in the input text;

inputting the phoneme duration parameter, the U/V parameter, the acoustic code of sentence, and the linguistic feature of sentence of the each sentence in the input text into the F0 model, to acquire the F0 parameter of the each sentence in the input text; and inputting the phoneme duration parameter, the U/V parameter, the F0 parameter, the acoustic code of sentence, and the linguistic feature of sentence of the each sentence in the input text into the energy spectrum model, to acquire the energy spectrum parameter of the each sentence in the input text.

A5. The method according to paragraph A1, further including:

inputting the parameter of acoustic feature of sentence of the each sentence in the input text into a voice vocoder to generate a speech to be outputted.

A6. The method according to paragraph A1, further including a training processing of generating the acoustic model, which includes:

extracting a text feature from each sentence in a training text, to acquire a semantic code of sentence, a sentence ID, and a linguistic feature of sentence of the each sentence in the training text;

extracting a speech feature from a training speech, to acquire the parameter of acoustic feature of sentence of the each sentence in the training text;

inputting the sentence ID of the each sentence, the linguistic feature of sentence, and the parameter of acoustic feature of sentence of the each sentence in the training text into an acoustic training model as first training data, to generate a trained acoustic model and an acoustic code of sentence of the each sentence in the training text via a training processing; and establishing a mapping relationship between the semantic code of sentence, the sentence ID, and the acoustic code of sentence of the each sentence in the training text, to generate the items in the dictionary of acoustic codes of sentences.

A7. The method according to paragraph A4, wherein the phoneme duration model, the U/V model and the F0 model are models generated by a training processing based on a first type of training speech, and the energy spectrum model is a model generated by a training processing based on a second type of training speech.

B1. A method, including:

extracting a text feature from each sentence in an input text, to acquire a semantic code of sentence and a linguistic feature of sentence of the each sentence in the input text;

inputting the semantic code of sentence of the each sentence in the input text and acoustic codes of sentence of a preset number of sentences ahead of the each sentence into a sequential model, to acquire the acoustic code of sentence of the each sentence in the input text; and inputting the acoustic code of sentence and the linguistic feature of sentence of the each sentence in the input text into an acoustic model, to acquire a parameter of acoustic feature of sentence of the each sentence in the input text.

B2. The method according to paragraph B1, wherein the acoustic model includes a phoneme duration model, a U/V model, an F0 model and an energy spectrum model, and the parameter of acoustic feature of sentence includes a phoneme duration parameter, a U/V parameter, an F0 parameter, and an energy spectrum parameter, and the inputting the acoustic code of sentence and the linguistic feature of sentence of the each sentence in the input text into an acoustic model, to acquire a parameter of acoustic feature of sentence of the each sentence in the input text includes:

inputting the acoustic code of sentence and the linguistic feature of sentence of the each sentence in the input text into the phoneme duration model, to acquire a phoneme duration parameter of the each sentence in the input text;

inputting the phoneme duration parameter, the acoustic code of sentence, and the linguistic feature of sentence of the each sentence in the input text into the U/V model, to acquire the U/V parameter of the each sentence in the input text;

inputting the phoneme duration parameter, the U/V parameter, the acoustic code of sentence, and the linguistic feature of sentence of the each sentence in the input text into the F0 model, to acquire the F0 parameter of the each sentence in the input text; and inputting the phoneme duration parameter, the U/V parameter, the F0 parameter, the acoustic code of sentence, and the linguistic feature of sentence of the each sentence in the input text into the energy spectrum model, to acquire the energy spectrum parameter of the each sentence in the input text.

B3. The method according to paragraph B1, further including:

inputting the parameter of acoustic feature of sentence of the each sentence in the input text into a voice vocoder to generate a speech to be outputted.

B4. The method according to paragraph B1, further including a training processing of generating the acoustic model and the sequential model, which includes:

extracting a text feature from each sentence in a training text, to acquire a semantic code of sentence, a sentence ID, and a linguistic feature of sentence of the each sentence in the training text;

extracting a speech feature from a training speech, to acquire the parameter of acoustic feature of sentence of the each sentence in the training text;

inputting the sentence ID of the each sentence, the linguistic feature of sentence, and the parameter of acoustic feature of sentence of the each sentence in the training text into an acoustic training model as first training data, to generate a trained acoustic model and an acoustic code of sentence of the each sentence in the training text by a training processing; and inputting the semantic code of sentence of the each sentence, the acoustic code of sentence, and the acoustic codes of sentence of a preset number of sentences ahead of the each sentence into a sequential training model as second training data, to generate a trained sequential model by a training processing.

B5. The method according to paragraph B2, wherein the phoneme duration model, the U/V model, and the F0 model are models generated by a training processing based on a first type of training speech, and the energy spectrum model is a model generated by a training processing based on a second type of training speech.

C1. A method, including:

extracting a text feature from each sentence in an input text, and acquiring a linguistic feature of sentence of the each sentence in the input text;

determining a sentence ID corresponding to the each sentence in the input text according to position information of the each sentence in the input text, in connection with a training text template matched with the dictionary of acoustic codes of sentences;

performing searching in the dictionary of acoustic codes of sentences according to the sentence ID corresponding to the each sentence in the input text, and acquiring the acoustic code of sentence corresponding to the sentence ID, wherein the dictionary of acoustic codes of sentences includes a plurality of items consisted of semantic codes of sentence, IDs of sentence, and acoustic codes of sentence, which have mapping relationship therebetween;

inputting the acoustic code of sentence and the linguistic feature of sentence of the each sentence in the input text into an acoustic model, and acquiring a parameter of acoustic feature of sentence of the each sentence in the input text.

C2. The method according to paragraph C1, further including:

inputting the parameter of acoustic feature of sentence of the each sentence in the input text into a voice vocoder and generating a speech to be outputted.

D1. A method, including:

extracting a text feature from each sentence in a training text, and acquiring a semantic code of sentence, a sentence ID, and a linguistic feature of sentence of the each sentence;

extracting a speech feature from a training speech, and acquiring a parameter of acoustic feature of sentence of the each sentence;

inputting the sentence ID of the each sentence, the linguistic feature of sentence and the parameter of acoustic feature of sentence of the each sentence into an acoustic training model as first training data, and generating a trained acoustic model and an acoustic code of sentence of the each sentence; and establishing a mapping relationship between the semantic code of sentence, the sentence ID, and the acoustic code of sentence of the each sentence, and generating the items in the dictionary of acoustic codes of sentences.

D2. The method according to paragraph D1, further including:

acquiring the acoustic codes of sentence of the preset number of sentences ahead of the each sentence according to the dictionary of acoustic codes of sentences; and inputting the semantic code of sentence of the each sentence, the acoustic code of sentence, and the acoustic codes of sentence of a preset number of sentences ahead of the each sentence into a sequential training model as second training data, and generating a trained sequential model.

E1. A device, including:

an input text feature extracting module configured to extract a text feature from each sentence in an input text, and acquire a semantic code of sentence and a linguistic feature of sentence of the each sentence in the input text;

a first searching module configured to perform searching of similarity matching in a dictionary of acoustic codes of sentences according to the semantic code of sentence of the each sentence in the input text, and acquire an acoustic code of sentence matched with the semantic code of sentence of the each sentence, wherein the dictionary of acoustic codes of sentences includes a plurality of items consisted of semantic codes of sentence, IDs of sentence, and acoustic codes of sentence, which have mapping relationship therebetween; and an acoustic model configured to generate a parameter of acoustic feature of sentence of the each sentence in the input text according to the acoustic code of sentence and the linguistic feature of sentence of the each sentence in the input text.

E2. The device according to paragraph E1, wherein the performing searching of similarity matching in a dictionary of acoustic codes of sentences according to the semantic code of sentence of the each sentence in the input text, and acquiring an acoustic code of sentence matched with the semantic code of sentence of the each sentence includes:

performing searching of similarity matching in a dictionary of acoustic codes of sentences according to the semantic code of sentence of the each sentence in the input text and the semantic code of sentence of a preset number of sentences in context of the each sentence in the input text, and acquiring an acoustic code of sentence matched with the semantic code of sentence of the each sentence in the input text.

E3. The device according to paragraph E1, wherein the performing searching of similarity matching in a dictionary of acoustic codes of sentences according to the semantic code of sentence of the each sentence in the input text, and acquiring an acoustic code of sentence matched with the semantic code of sentence of the each sentence includes:

determining a sentence ID corresponding to the each sentence in the input text according to position information of the each sentence in the input text, in connection with a training text template matched with the dictionary of acoustic codes of sentences; and performing searching of similarity matching in the dictionary of acoustic codes of sentences according to the semantic code of sentence and the determined sentence ID of the each sentence in the input text, and acquiring the acoustic code of sentence matched with the semantic code of sentence of the each sentence in the input text.

E4. The device according to paragraph E1, wherein the acoustic model includes a phoneme duration model, a U/V model, an F0 model and an energy spectrum model, and the parameter of acoustic feature of sentence includes a phoneme duration parameter, a U/V parameter, an F0 parameter, and an energy spectrum parameter, the phoneme duration model is configured to generate a phoneme duration parameter of the each sentence in the input text according to the acoustic code of sentence and the linguistic feature of sentence of the each sentence in the input text;

the U/V model is configured to generate the U/V parameter of the each sentence in the input text according to the phoneme duration parameter, the acoustic code of sentence, and the linguistic feature of sentence of the each sentence in the input text;

the F0 model is configured to generate the F0 parameter of the each sentence in the input text according to the phoneme duration parameter, the U/V parameter, the acoustic code of sentence, and the linguistic feature of sentence of the each sentence in the input text; and the energy spectrum model is configured to generate the energy spectrum parameter of the each sentence in the input text according to the phoneme duration parameter, the U/V parameter, the F0 parameter, the acoustic code of sentence, and the linguistic feature of sentence of the each sentence in the input text.

E5. The device according to paragraph E1, further including:

a voice vocoder configured to generate a speech to be outputted according to the parameter of acoustic feature of sentence of the each sentence in the input text.

E6. The device according to paragraph E4, wherein the phoneme duration model, the U/V model and the F0 model are models generated by a training processing based on a first type of training speech, and the energy spectrum model is a model generated by a training processing based on a second type of training speech.

F1. A device, including:

an input text feature extracting module configured to extract a text feature from each sentence in an input text, and acquire a semantic code of sentence and a linguistic feature of sentence of the each sentence in the input text;

a sequential model configured to predict the acoustic code of sentence of the each sentence in the input text according to the semantic code of sentence of the each sentence in the input text and acoustic codes of sentence of a preset number of sentences ahead of the each sentence; and an acoustic model configured to generate a parameter of acoustic feature of sentence of the each sentence in the input text according to the acoustic code of sentence and the linguistic feature of sentence of the each sentence in the input text.

F2. The device according to paragraph F1, wherein the acoustic model includes a phoneme duration model, a U/V model, an F0 model and an energy spectrum model, and the parameter of acoustic feature of sentence includes a phoneme duration parameter, a U/V parameter, an F0 parameter, and an energy spectrum parameter, the phoneme duration model is configured to generate a phoneme duration parameter of the each sentence in the input text according to the acoustic code of sentence and the linguistic feature of sentence of the each sentence in the input text;

the U/V model is configured to generate the U/V parameter of the each sentence in the input text according to the phoneme duration parameter, the acoustic code of sentence, and the linguistic feature of sentence of the each sentence in the input text;

the F0 model is configured to generate the F0 parameter of the each sentence in the input text according to the phoneme duration parameter, the U/V parameter, the acoustic code of sentence, and the linguistic feature of sentence of the each sentence in the input text; and the energy spectrum model is configured to generate the energy spectrum parameter of the each sentence in the input text according to the phoneme duration parameter, the U/V parameter, the F0 parameter, the acoustic code of sentence, and the linguistic feature of sentence of the each sentence in the input text.

F3. The device according to paragraph F1, further including:

a voice vocoder configured to generate a speech to be outputted according to the parameter of acoustic feature of sentence of the each sentence in the input text.

F4. The device according to paragraph F2, wherein the phoneme duration model, the U/V model, and the F0 model are models generated by a training processing based on a first type of training speech, and the energy spectrum model is a model generated by a training processing based on a second type of training speech.

G1. A device, including:

an input text feature extracting module configured to extract a text feature from each sentence in an input text, and acquire a linguistic feature of sentence of the each sentence in the input text;

a sentence ID determining module configured to determine a sentence ID corresponding to the each sentence in the input text according to position information of the each sentence in the input text, in connection with a training text template matched with the dictionary of acoustic codes of sentences;

a second searching module configured to perform searching in the dictionary of acoustic codes of sentences according to the sentence ID corresponding to the each sentence in the input text, and acquiring the acoustic code of sentence corresponding to the sentence ID, wherein the dictionary of acoustic codes of sentences includes a plurality of items consisted of semantic codes of sentence, IDs of sentence, and acoustic codes of sentence, which have mapping relationship therebetween;

an acoustic model configured to generate a parameter of acoustic feature of sentence of the each sentence in the input text according to the acoustic code of sentence and the linguistic feature of sentence of the each sentence in the input text.

G2. The device according to paragraph G1, further including:

a voice vocoder configured to generate a speech to be outputted according to the parameter of acoustic feature of sentence of the each sentence in the input text.

H1. A device, including:

a training text feature extracting module configured to extract a text feature from each sentence in a training text, and acquire a semantic code of sentence, a sentence ID, and a linguistic feature of sentence of the each sentence;

a training speech feature extracting module configured to extract a speech feature from a training speech, and acquire a parameter of acoustic feature of sentence of the each sentence;

an acoustic model training module configured to input the sentence ID of the each sentence, the linguistic feature of sentence and the parameter of acoustic feature of sentence of the each sentence into an acoustic training model as first training data, and generate a trained acoustic model and an acoustic code of sentence of the each sentence; and a dictionary generating module configured to establish a mapping relationship between the semantic code of sentence, the sentence ID, and the acoustic code of sentence of the each sentence, and generate the items in the dictionary of acoustic codes of sentences.

H2. The device according to paragraph H1, further including:

a sentence acoustic code acquiring module configured to acquire the acoustic codes of sentence of the preset number of sentences ahead of the each sentence according to the dictionary of acoustic codes of sentences; and a sequential model training module configured to input the semantic code of sentence of the each sentence, the acoustic code of sentence, and the acoustic codes of sentence of a preset number of sentences ahead of the each sentence into a sequential training model as second training data, and generate a trained sequential model.

I1. An electronic apparatus, including:

a processing unit; and a memory, coupled to the processing unit and containing instructions stored thereon, the instructions cause the electronic apparatus to perform operations upon being executed by the processing unit, the operations include:

extracting a text feature from each sentence in an input text, and acquiring a semantic code of sentence and a linguistic feature of sentence of the each sentence in the input text;

performing searching of similarity matching in a dictionary of acoustic codes of sentences according to the semantic code of sentence of the each sentence in the input text, and acquiring an acoustic code of sentence matched with the semantic code of sentence of the each sentence, wherein the dictionary of acoustic codes of sentences includes a plurality of items consisted of semantic codes of sentence, IDs of sentence, and acoustic codes of sentence, which have mapping relationship therebetween; and inputting the acoustic code of sentence and the linguistic feature of sentence of the each sentence in the input text into an acoustic model, and acquiring a parameter of acoustic feature of sentence of the each sentence in the input text.

I2. The electronic apparatus according to paragraph I1, wherein the performing searching of similarity matching in a dictionary of acoustic codes of sentences according to the semantic code of sentence of the each sentence in the input text, and acquiring an acoustic code of sentence matched with the semantic code of sentence of the each sentence includes:

performing searching of similarity matching in a dictionary of acoustic codes of sentences according to the semantic code of sentence of the each sentence in the input text and the semantic code of sentence of a preset number of sentences in context of the each sentence in the input text, and acquiring an acoustic code of sentence matched with the semantic code of sentence of the each sentence in the input text.

I3. The electronic apparatus according to paragraph I1, wherein the performing searching of similarity matching in a dictionary of acoustic codes of sentences according to the semantic code of sentence of the each sentence in the input text, and acquiring an acoustic code of sentence matched with the semantic code of sentence of the each sentence includes:

determining a sentence ID corresponding to the each sentence in the input text according to position information of the each sentence in the input text, in connection with a training text template matched with the dictionary of acoustic codes of sentences; and performing searching of similarity matching in the dictionary of acoustic codes of sentences according to the semantic code of sentence and the determined sentence ID of the each sentence in the input text, and acquiring the acoustic code of sentence matched with the semantic code of sentence of the each sentence in the input text.

I4. The electronic apparatus according to paragraph I1, wherein the acoustic model includes a phoneme duration model, a U/V model, an F0 model and an energy spectrum model, and the parameter of acoustic feature of sentence includes a phoneme duration parameter, a U/V parameter, an F0 parameter, and an energy spectrum parameter, and the inputting the acoustic code of sentence and the linguistic feature of sentence of the each sentence in the input text into an acoustic model, and acquiring a parameter of acoustic feature of sentence of the each sentence in the input text includes:

inputting the acoustic code of sentence and the linguistic feature of sentence of the each sentence in the input text into the phoneme duration model, and acquiring a phoneme duration parameter of the each sentence in the input text;

inputting the phoneme duration parameter, the acoustic code of sentence, and the linguistic feature of sentence of the each sentence in the input text into the U/V model, and acquiring the U/V parameter of the each sentence in the input text;

inputting the phoneme duration parameter, the U/V parameter, the acoustic code of sentence, and the linguistic feature of sentence of the each sentence in the input text into the F0 model, and acquiring the F0 parameter of the each sentence in the input text; and inputting the phoneme duration parameter, the U/V parameter, the F0 parameter, the acoustic code of sentence, and the linguistic feature of sentence of the each sentence in the input text into the energy spectrum model, and acquiring the energy spectrum parameter of the each sentence in the input text.

I5. The electronic apparatus according to paragraph I1, wherein the operations further include:

inputting the parameter of acoustic feature of sentence of the each sentence in the input text into a voice vocoder and generating a speech to be outputted.

I6. The electronic apparatus according to paragraph I1, wherein the operations further include a training processing of generating the acoustic model, which includes:

extracting a text feature from each sentence in a training text, and acquiring a semantic code of sentence, a sentence ID, and a linguistic feature of sentence of the each sentence in the training text;

extracting a speech feature from a training speech, and acquiring the parameter of acoustic feature of sentence of the each sentence in the training text;

inputting the sentence ID of the each sentence, the linguistic feature of sentence, and the parameter of acoustic feature of sentence of the each sentence in the training text into an acoustic training model as first training data, and generating a trained acoustic model and an acoustic code of sentence of the each sentence in the training text via a training processing; and establishing a mapping relationship between the semantic code of sentence, the sentence ID, and the acoustic code of sentence of the each sentence in the training text, and generating the items in the dictionary of acoustic codes of sentences.

I7. The electronic apparatus according to paragraph I4, wherein the phoneme duration model, the U/V model and the F0 model are models generated by a training processing based on a first type of training speech, and the energy spectrum model is a model generated by a training processing based on a second type of training speech.

J1. An electronic apparatus, including:

a processing unit; and a memory, coupled to the processing unit and containing instructions stored thereon, the instructions cause the electronic apparatus to perform operations upon being executed by the processing unit, the operations include:

extracting a text feature from each sentence in an input text, and acquiring a semantic code of sentence and a linguistic feature of sentence of the each sentence in the input text;

inputting the semantic code of sentence of the each sentence in the input text and acoustic codes of sentence of a preset number of sentences ahead of the each sentence into a sequential model, and acquiring the acoustic code of sentence of the each sentence in the input text; and inputting the acoustic code of sentence and the linguistic feature of sentence of the each sentence in the input text into an acoustic model, and acquiring a parameter of acoustic feature of sentence of the each sentence in the input text.

J2. The electronic apparatus according to paragraph J1, wherein the acoustic model includes a phoneme duration model, a U/V model, an F0 model and an energy spectrum model, and the parameter of acoustic feature of sentence includes a phoneme duration parameter, a U/V parameter, an F0 parameter, and an energy spectrum parameter, and the inputting the acoustic code of sentence and the linguistic feature of sentence of the each sentence in the input text into an acoustic model, and acquiring a parameter of acoustic feature of sentence of the each sentence in the input text includes:

inputting the acoustic code of sentence and the linguistic feature of sentence of the each sentence in the input text into the phoneme duration model, and acquiring a phoneme duration parameter of the each sentence in the input text;

inputting the phoneme duration parameter, the acoustic code of sentence, and the linguistic feature of sentence of the each sentence in the input text into the U/V model, and acquiring the U/V parameter of the each sentence in the input text;

inputting the phoneme duration parameter, the U/V parameter, the acoustic code of sentence, and the linguistic feature of sentence of the each sentence in the input text into the F0 model, and acquiring the F0 parameter of the each sentence in the input text; and inputting the phoneme duration parameter, the U/V parameter, the F0 parameter, the acoustic code of sentence, and the linguistic feature of sentence of the each sentence in the input text into the energy spectrum model, and acquiring the energy spectrum parameter of the each sentence in the input text.

J3. The electronic apparatus according to paragraph J1, wherein the operations further include:

inputting the parameter of acoustic feature of sentence of the each sentence in the input text into a voice vocoder to generate a speech to be outputted.

K1. An electronic apparatus, including:

a processing unit; and a memory, coupled to the processing unit and containing instructions stored thereon, the instructions cause the electronic apparatus to perform operations upon being executed by the processing unit, the operations include:

extracting a text feature from each sentence in an input text, and acquiring a linguistic feature of sentence of the each sentence in the input text;

determining a sentence ID corresponding to the each sentence in the input text according to position information of the each sentence in the input text, in connection with a training text template matched with the dictionary of acoustic codes of sentences;

performing searching in the dictionary of acoustic codes of sentences according to the sentence ID corresponding to the each sentence in the input text, and acquiring the acoustic code of sentence corresponding to the sentence ID, wherein the dictionary of acoustic codes of sentences includes a plurality of items consisted of semantic codes of sentence, IDs of sentence, and acoustic codes of sentence, which have mapping relationship therebetween;

inputting the acoustic code of sentence and the linguistic feature of sentence of the each sentence in the input text into an acoustic model, and acquiring a parameter of acoustic feature of sentence of the each sentence in the input text.

K2. The electronic apparatus according to paragraph K1, wherein the operations further include:

inputting the parameter of acoustic feature of sentence of the each sentence in the input text into a voice vocoder and generating a speech to be outputted.

L1. An electronic apparatus, including:

a processing unit; and a memory, coupled to the processing unit and containing instructions stored thereon, the instructions cause the electronic apparatus to perform operations upon being executed by the processing unit, the operations include:

extracting a text feature from each sentence in a training text, and acquiring a semantic code of sentence, a sentence ID, and a linguistic feature of sentence of the each sentence;

extracting a speech feature from a training speech, and acquiring a parameter of acoustic feature of sentence of the each sentence;

inputting the sentence ID of the each sentence, the linguistic feature of sentence and the parameter of acoustic feature of sentence of the each sentence into an acoustic training model as first training data, and generating a trained acoustic model and an acoustic code of sentence of the each sentence; and establishing a mapping relationship between the semantic code of sentence, the sentence ID, and the acoustic code of sentence of the each sentence, and generating the items in the dictionary of acoustic codes of sentences.

L2. The electronic apparatus according to paragraph L1, wherein the operations further include:

acquiring the acoustic codes of sentence of the preset number of sentences ahead of the each sentence according to the dictionary of acoustic codes of sentences; and inputting the semantic code of sentence of the each sentence, the acoustic code of sentence, and the acoustic codes of sentence of a preset number of sentences ahead of the each sentence into a sequential training model as second training data, and generating a trained sequential model.

CONCLUSION

There is little distinction left between hardware and software implementations of aspects of systems; the use of hardware or software is generally (but not always, in that in certain contexts the choice between hardware and software can become significant) a design choice representing cost versus efficiency tradeoffs. There are various vehicles by which processes and/or systems and/or other technologies described herein can be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation; or, yet again alternatively, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Versatile Disk (DVD), a digital tape, a computer memory, etc.; and a transmission type medium such as a digital and/or an analog communication medium (e.g., a fiber optic cable, a waveguide, a wired communications link, a wireless communication link, etc.).

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and nonvolatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to disclosures containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

Reference in the specification to "an implementation", "one implementation", "some implementations", or "other implementations" may mean that a particular feature, structure, or characteristic described in connection with one or more implementations may be included in at least some implementations, but not necessarily in all implementations. The various appearances of "an implementation", "one implementation", or "some implementations" in the preceding description are not necessarily all referring to the same implementations.

While certain exemplary techniques have been described and shown herein using various methods and systems, it should be understood by those skilled in the art that various other modifications may be made, and equivalents may be substituted, without departing from claimed subject matter. Additionally, many modifications may be made to adapt a particular situation to the teachings of claimed subject matter without departing from the central concept described herein. Therefore, it is intended that claimed subject matter not be limited to the particular examples disclosed, but that such claimed subject matter also may include all implementations falling within the scope of the appended claims, and equivalents thereof.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

Conditional language such as, among others, "can," "could," "might" or "may," unless specifically stated otherwise, are otherwise understood within the context as used in general to present that certain examples include, while other examples do not include, certain features, elements and/or steps. Thus, such conditional language is not generally intended to imply that features, elements and/or steps are in any way required for one or more examples or that one or more examples necessarily include logic for deciding, with or without user input or prompting, whether these features, elements and/or steps are included or are to be performed in any particular example.

Conjunctive language such as the phrase "at least one of X, Y or Z," unless specifically stated otherwise, is to be understood to present that an item, term, etc. can be either X, Y, or Z, or a combination thereof.

Any routine descriptions, elements or blocks in the flow diagrams described herein and/or depicted in the attached figures should be understood as potentially representing modules, segments, or portions of code that include one or more executable instructions for implementing specific logical functions or elements in the routine. Alternate examples are included within the scope of the examples described herein in which elements or functions can be deleted, or executed out of order from that shown or discussed, including substantially synchronously or in reverse order, depending on the functionality involved as would be understood by those skilled in the art.

It should be emphasized that many variations and modifications can be made to the above-described examples, the elements of which are to be understood as being among other acceptable examples. All such modifications and variations are intended to be included herein within the scope of this disclosure and protected by the following claims It would be obvious to one skilled in the art that, all or part of steps for implementing the above embodiments may be accomplished by hardware related to programs or instructions. The above program may be stored in a computer readable storing medium. Such program may perform the steps of the above embodiments upon being executed. The above storing medium may include: ROM, RAM, magnetic disk, or optic disk or other medium capable of storing program codes.

It should be noted that the foregoing embodiments are merely used to illustrate the technical solution of the present disclosure, and not to limit the present disclosure. Although the present disclosure has been described in detail with reference to the foregoing embodiments, one skilled in the art would understand that the technical solutions recited in the foregoing embodiments may be modified or all or a part of the technical features may be replaced equally. These modifications and replacements are not intended to make corresponding technical solution depart from the scope of the technical solution of embodiments of the present disclosure.

The invention claimed is:

1. An electronic apparatus, comprising:

a processing unit; and a memory, coupled to the processing unit and containing instructions stored thereon, the instructions cause the electronic apparatus to perform operations upon being executed by the processing unit, the operations comprising:

extracting a text feature from each sentence in an input text, to acquire a semantic code of sentence and a linguistic feature of sentence of the each sentence in the input text;

performing searching of similarity matching in a dictionary of acoustic codes of sentences according to the semantic code of sentence of the each sentence in the input text, to acquire an acoustic code of sentence matched with the semantic code of sentence of the each sentence, wherein the dictionary of acoustic codes of sentences comprises a plurality of items consisted of semantic codes of sentence, IDs of sentence, and acoustic codes of sentence, which have mapping relationship therebetween; and inputting the acoustic code of sentence and the linguistic feature of sentence of the each sentence in the input text into an acoustic model, to acquire a parameter of acoustic feature of sentence of the each sentence in the input text.

2. The electronic apparatus according to claim 1, wherein the performing searching of similarity matching in a dictionary of acoustic codes of sentences according to the semantic code of sentence of the each sentence in the input text, to acquire an acoustic code of sentence matched with the semantic code of sentence of the each sentence comprises:

performing searching of similarity matching in a dictionary of acoustic codes of sentences according to the semantic code of sentence of the each sentence in the input text and the semantic code of sentence of a preset number of sentences in context of the each sentence in the input text, to acquire an acoustic code of sentence matched with the semantic code of sentence of the each sentence in the input text.

3. The electronic apparatus according to claim 1, wherein the performing searching of similarity matching in a dictionary of acoustic codes of sentences according to the semantic code of sentence of the each sentence in the input text, to acquire an acoustic code of sentence matched with the semantic code of sentence of the each sentence comprises:

determining a sentence ID corresponding to the each sentence in the input text according to position information of the each sentence in the input text, in connection with a training text template matched with the dictionary of acoustic codes of sentences; and performing searching of similarity matching in the dictionary of acoustic codes of sentences according to the semantic code of sentence and the determined sentence ID of the each sentence in the input text, to acquire the acoustic code of sentence matched with the semantic code of sentence of the each sentence in the input text.

4. The electronic apparatus according to claim 1, wherein the acoustic model comprises a phoneme duration model, a U/V model, an F0 model and an energy spectrum model, and the parameter of acoustic feature of sentence comprises a phoneme duration parameter, a U/V parameter, an F0 parameter, and an energy spectrum parameter, and the inputting the acoustic code of sentence and the linguistic feature of sentence of the each sentence in the input text into an acoustic model, to acquire a parameter of acoustic feature of sentence of the each sentence in the input text comprises:

inputting the acoustic code of sentence and the linguistic feature of sentence of the each sentence in the input text into the phoneme duration model, to acquire a phoneme duration parameter of the each sentence in the input text;

inputting the phoneme duration parameter, the acoustic code of sentence, and the linguistic feature of sentence of the each sentence in the input text into the U/V model, to acquire the U/V parameter of the each sentence in the input text;

inputting the phoneme duration parameter, the U/V parameter, the acoustic code of sentence, and the linguistic feature of sentence of the each sentence in the input text into the F0 model, to acquire the F0 parameter of the each sentence in the input text; and inputting the phoneme duration parameter, the U/V parameter, the F0 parameter, the acoustic code of sentence, and the linguistic feature of sentence of the each sentence in the input text into the energy spectrum model, to acquire the energy spectrum parameter of the each sentence in the input text.

5. The electronic apparatus according to claim 1, wherein the operations further comprise:

inputting the parameter of acoustic feature of sentence of the each sentence in the input text into a voice vocoder to generate a speech to be outputted.

6. The electronic apparatus according to claim 1, wherein the operations further comprise a training processing of generating the acoustic model, which comprises:

extracting a text feature from each sentence in a training text, to acquire a semantic code of sentence, a sentence ID, and a linguistic feature of sentence of the each sentence in the training text;

extracting a speech feature from a training speech, to acquire the parameter of acoustic feature of sentence of the each sentence in the training text;

inputting the sentence ID of the each sentence, the linguistic feature of sentence, and the parameter of acoustic feature of sentence of the each sentence in the training text into an acoustic training model as first training data, to generate a trained acoustic model and an acoustic code of sentence of the each sentence in the training text via a training processing; and establishing a mapping relationship between the semantic code of sentence, the sentence ID, and the acoustic code of sentence of the each sentence in the training text, to generate the items in the dictionary of acoustic codes of sentences.

7. The electronic apparatus according to claim 4, wherein the phoneme duration model, the U/V model and the F0 model are models generated by a training processing based on a first type of training speech, and the energy spectrum model is a model generated by a training processing based on a second type of training speech.

8. A method, comprising:

extracting a text feature from each sentence in an input text, to acquire a semantic code of sentence and a linguistic feature of sentence of the each sentence in the input text;

performing searching of similarity matching in a dictionary of acoustic codes of sentences according to the semantic code of sentence of the each sentence in the input text, to acquire an acoustic code of sentence matched with the semantic code of sentence of the each sentence, wherein the dictionary of acoustic codes of sentences comprises a plurality of items consisted of semantic codes of sentence, IDs of sentence, and acoustic codes of sentence, which have mapping relationship therebetween; and inputting the acoustic code of sentence and the linguistic feature of sentence of the each sentence in the input text into an acoustic model, to acquire a parameter of acoustic feature of sentence of the each sentence in the input text.

9. The method according to claim 8, wherein the performing searching of similarity matching in a dictionary of acoustic codes of sentences according to the semantic code of sentence of the each sentence in the input text, to acquire an acoustic code of sentence matched with the semantic code of sentence of the each sentence comprises:

performing searching of similarity matching in a dictionary of acoustic codes of sentences according to the semantic code of sentence of the each sentence in the input text and the semantic code of sentence of a preset number of sentences in context of the each sentence in the input text, to acquire an acoustic code of sentence matched with the semantic code of sentence of the each sentence in the input text.

10. The method according to claim 8, wherein the performing searching of similarity matching in a dictionary of acoustic codes of sentences according to the semantic code of sentence of the each sentence in the input text, to acquire an acoustic code of sentence matched with the semantic code of sentence of the each sentence comprises:

determining a sentence ID corresponding to the each sentence in the input text according to position information of the each sentence in the input text, in connection with a training text template matched with the dictionary of acoustic codes of sentences; and performing searching of similarity matching in the dictionary of acoustic codes of sentences according to the semantic code of sentence and the determined sentence ID of the each sentence in the input text, to acquire the acoustic code of sentence matched with the semantic code of sentence of the each sentence in the input text.

11. The method according to claim 8, wherein the acoustic model comprises a phoneme duration model, a U/V model, an F0 model and an energy spectrum model, and the parameter of acoustic feature of sentence comprises a phoneme duration parameter, a U/V parameter, an F0 parameter, and an energy spectrum parameter, and the inputting the acoustic code of sentence and the linguistic feature of sentence of the each sentence in the input text into an acoustic model, to acquire a parameter of acoustic feature of sentence of the each sentence in the input text comprises:

inputting the acoustic code of sentence and the linguistic feature of sentence of the each sentence in the input text into the phoneme duration model, to acquire a phoneme duration parameter of the each sentence in the input text;

inputting the phoneme duration parameter, the acoustic code of sentence, and the linguistic feature of sentence of the each sentence in the input text into the U/V model, to acquire the U/V parameter of the each sentence in the input text;

inputting the phoneme duration parameter, the U/V parameter, the acoustic code of sentence, and the linguistic feature of sentence of the each sentence in the input text into the F0 model, to acquire the F0 parameter of the each sentence in the input text; and inputting the phoneme duration parameter, the U/V parameter, the F0 parameter, the acoustic code of sentence, and the linguistic feature of sentence of the each sentence in the input text into the energy spectrum model, to acquire the energy spectrum parameter of the each sentence in the input text.

12. The method according to claim 8, further comprising a training processing of generating the acoustic model, which comprises:

extracting a text feature from each sentence in a training text, to acquire a semantic code of sentence, a sentence ID, and a linguistic feature of sentence of the each sentence in the training text;

extracting a speech feature from a training speech, to acquire the parameter of acoustic feature of sentence of the each sentence in the training text;

inputting the sentence ID of the each sentence, the linguistic feature of sentence, and the parameter of acoustic feature of sentence of the each sentence in the training text into an acoustic training model as first training data, to generate a trained acoustic model and an acoustic code of sentence of the each sentence in the training text via a training processing; and establishing a mapping relationship between the semantic code of sentence, the sentence ID, and the acoustic code of sentence of the each sentence in the training text, to generate the items in the dictionary of acoustic codes of sentences.

13. A method, comprising:

extracting a text feature from each sentence in an input text, to acquire a semantic code of sentence and a linguistic feature of sentence of the each sentence in the input text;

inputting the semantic code of sentence of the each sentence in the input text and acoustic codes of sentence of a preset number of sentences ahead of the each sentence into a sequential model, to acquire the acoustic code of sentence of the each sentence in the input text; and inputting the acoustic code of sentence and the linguistic feature of sentence of the each sentence in the input text into an acoustic model, to acquire a parameter of acoustic feature of sentence of the each sentence in the input text.

14. The method according to claim 13, wherein the acoustic model comprises a phoneme duration model, a U/V model, an F0 model and an energy spectrum model, and the parameter of acoustic feature of sentence comprises a phoneme duration parameter, a U/V parameter, an F0 parameter, and an energy spectrum parameter, and the inputting the acoustic code of sentence and the linguistic feature of sentence of the each sentence in the input text into an acoustic model, to acquire a parameter of acoustic feature of sentence of the each sentence in the input text comprises:

inputting the acoustic code of sentence and the linguistic feature of sentence of the each sentence in the input text into the phoneme duration model, to acquire a phoneme duration parameter of the each sentence in the input text;

inputting the phoneme duration parameter, the acoustic code of sentence, and the linguistic feature of sentence of the each sentence in the input text into the U/V model, to acquire the U/V parameter of the each sentence in the input text;

inputting the phoneme duration parameter, the U/V parameter, the acoustic code of sentence, and the linguistic feature of sentence of the each sentence in the input text into the F0 model, to acquire the F0 parameter of the each sentence in the input text; and inputting the phoneme duration parameter, the U/V parameter, the F0 parameter, the acoustic code of sentence, and the linguistic feature of sentence of the each sentence in the input text into the energy spectrum model, to acquire the energy spectrum parameter of the each sentence in the input text.

15. The method according to claim 13, further comprising a training processing of generating the acoustic model and the sequential model, which comprises:

extracting a text feature from each sentence in a training text, to acquire a semantic code of sentence, a sentence ID, and a linguistic feature of sentence of the each sentence in the training text;

extracting a speech feature from a training speech, to acquire the parameter of acoustic feature of sentence of the each sentence in the training text;

inputting the sentence ID of the each sentence, the linguistic feature of sentence, and the parameter of acoustic feature of sentence of the each sentence in the training text into an acoustic training model as first training data, to generate a trained acoustic model and an acoustic code of sentence of the each sentence in the training text by a training processing; and inputting the semantic code of sentence of the each sentence, the acoustic code of sentence, and the acoustic codes of sentence of a preset number of sentences ahead of the each sentence into a sequential training model as second training data, to generate a trained sequential model by a training processing.

* * * * *